US009017000B2

(12) United States Patent
McDowell, Jr. et al.

(10) Patent No.: US 9,017,000 B2
(45) Date of Patent: Apr. 28, 2015

(54) AUTOMATIC PARKING STRUCTURE

(75) Inventors: Joseph Coleman McDowell, Jr., Flower Mound, TX (US); Michael Corbett Story, Grand Prairie, TX (US); James Bowmer Story, Highland Village, TX (US); Charles Jefferson Fritts, Highland Village, TX (US); Juan Carlos Acevedo, Lewisville, TX (US); Victor Dale Trotter, Fort Worth, TX (US); Len Keith Averyt, Rhome, TX (US); Christopher Corbett Story, Arlington, TX (US)

(73) Assignee: Safe Parking Limited, Katy, TX (US)

( * ) Notice: Subject to any disclaimer, the term of this patent is extended or adjusted under 35 U.S.C. 154(b) by 1369 days.

(21) Appl. No.: 12/444,887

(22) PCT Filed: Jul. 6, 2007
(Under 37 CFR 1.47)

(86) PCT No.: PCT/US2007/072938

§ 371 (c)(1),
(2), (4) Date: Aug. 11, 2010

(87) PCT Pub. No.: WO2008/045606

PCT Pub. Date: Apr. 17, 2008

(65) Prior Publication Data

US 2011/0082588 A1 Apr. 7, 2011

Related U.S. Application Data

(60) Provisional application No. 60/828,768, filed on Oct. 9, 2006.

(51) Int. Cl.
*E04H 6/22* (2006.01)
*E04H 6/18* (2006.01)

(52) U.S. Cl.
CPC ..... *E04H 6/183* (2013.01); *E04H 6/225* (2013.01)

(58) Field of Classification Search
CPC ..... E04H 6/183; E04H 6/186
USPC ..... 414/255, 256, 258, 260, 277, 280, 283
See application file for complete search history.

(56) References Cited

U.S. PATENT DOCUMENTS 2,663,446 A 12/1953 Romain
4,968,208 A * 11/1990 Friberg ..... 414/256

(Continued)

FOREIGN PATENT DOCUMENTS

WO WO 2005059276 A1 * 6/2005

OTHER PUBLICATIONS

PCT International Search Report mailed Dec. 26, 2007 for PCT/US07/72938.

*Primary Examiner* — Jonathan Snelting
(74) *Attorney, Agent, or Firm* — Andrew W. Chu; Craft Chu PLLC

(57) ABSTRACT

The present invention as disclosed herein is an improved vehicle parking structure and method for using the same. The vehicle parking structure provides for the automated storage and retrieval of vehicles in response to user inputs. In one aspect, the vehicle parking structure comprises one or more transfer rooms in which a vehicle operator may deposit and later retrieve a vehicle, a plurality of parking spaces of either fixed or variable dimensions, and one or more vehicle transporters used to move vehicles from the one or more transfer rooms to the plurality of parking spaces. The one or more vehicle transporters are in turn each preferably comprised of one or more vertical stabilizers, one or more tractors, one or more lifts, a lifting platform, and a dolly. The vehicle transporters move the lifting platform and dolly so that the dolly may be positioned to access a vehicle located in a transfer room or parking space.

27 Claims, 17 Drawing Sheets

(56) References Cited

U.S. PATENT DOCUMENTS 5,275,064 A * 1/1994 Hobbs ..... 74/110
5,286,156 A * 2/1994 Ikenouchi et al. ..... 414/256
5,292,218 A * 3/1994 Ikenouchi et al. ..... 414/256
5,320,473 A * 6/1994 Arnold et al. ..... 414/253
5,456,562 A * 10/1995 Schlecker et al. ..... 414/254
5,678,972 A 10/1997 Bockler et al.
6,199,490 B1 * 3/2001 Langer ..... 108/143

* cited by examiner

AUTOMATIC PARKING STRUCTURE

RELATED U.S. APPLICATIONS

The present application claims priority, under 35 U.S.C. Section 119(e), according to 37 CFR 1.78(a)(2), from U.S. Provisional Patent Application Ser. No. 60/828,768, filed on 9 Oct. 2006, entitled "AUTOMATIC PARKING STRUCTURE".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The invention relates to structures, mechanisms, methods and systems used for storing and retrieving articles, such as passenger cars.

2. Description of Related Art Including Information Disclosed Under 37 CFR 1.97 and 37 CFR 1.98.

In many real estate developments, the space required to park passenger vehicles is a large part of the cost. It is desirable to minimize this cost. An automated parking structure in which vehicles are parked in close proximity without the space needed to open and close doors or for people to enter or exit the vehicles can increase the number of vehicles parked in a given volume or surface footprint. Such structures may use vehicle moving equipment to pick and place the vehicles into parking slots. These structures usually require that various parts of the parking structure, including the transfer room(s) through which the vehicles enter and leave the parking structure, have fixed elements that, in these designs, are required to interact with some form of vehicle moving equipment. For example, some automated parking structures require that the transfer room have a floor with one or more open slots through which parts of a vehicle transfer apparatus can pass. In these systems, the vehicle moving equipment is thicker than the space allowed by the vehicle ground clearance. Slots are therefore required to enable the prior vehicle moving equipment to pass under the vehicle body so that it may engage the vehicle without damaging its bodywork. Similar slots are then required in the parking storage space to allow the vehicle to be placed there by the prior vehicle moving equipment. These slots, grooves and similar accommodations add cost and complexity to the parking structure. Further, they make it difficult to change the size of a parking space as the slots, grooves or other accommodations are often integral with the fixed floor and can not be moved or easily modified. Finally, the addition of slots, grooves and similar accommodations may increase the thickness of each parking floor, thereby potentially reducing the number of parking floors possible in a structure of a given height. However, as vehicle demographics change, it may be desirable for a garage operator to be able to either widen or narrow the parking spaces to maximize revenue at that facility or adjust to a change in the size mix of vehicles using the facility.

An additional consideration in the design of an automated parking structure is the amount of time required to place or retrieve a vehicle, known as vehicle throughput. The prior art generally carries out various steps in the parking process in sequence, for example by waiting until the apparatus has moved under the vehicle to adjust the vehicle moving equipment to accommodate the wheelbase of the vehicle to be transferred. This is a sequential operation and thus requires time for the equipment to first move under the vehicle, locate a first set of tires, adjust to that location, and then determine the position of the second set of tires and adjust to that position. The sequential nature of this operation is thus one of the factors directly affecting the throughput of the garage. A solution that eliminates or reduces the time lost adjusting the equipment to the particular vehicle to be moved has not been demonstrated in the prior art. However, measuring the wheelbase of an incoming vehicle prior to it being engaged by the vehicle transfer apparatus of the present invention, and then preadjusting the vehicle transfer apparatus while it is approaching the vehicle, will eliminate loss of time. This will improve the operation of the parking facility by lessening the time required to adjust the vehicle transfer apparatus to the particular wheelbase of the vehicle to be moved.

Another consideration in the design of an automated parking structure is the desired orientation of vehicles as they are retrieved from the parking structure. That is, the designer must consider whether, when the vehicle is returned to its driver, it is to be oriented so that it can be driven out of the transfer room in a forward direction, or if it is acceptable to return the vehicle so that it must be driven out in reverse. In the present invention, this problem is addressed by incorporating a turntable and a bi-directional dolly. The turntable is operable to rotate the vehicle at least 180 degrees, while the bi-directional dolly enables the vehicle to be retrieved or deployed from either side of the vehicle transfer apparatus such that the vehicle can be oriented in the transfer room ready for an easy exit.

SUMMARY OF THE INVENTION

The present invention as disclosed herein is an improved vehicle parking structure. The vehicle parking structure provides for the automated storage and retrieval of vehicles in response to user inputs. In one aspect, the vehicle parking structure comprises one or more transfer rooms in which a vehicle operator may deposit and later retrieve a vehicle, a plurality of parking spaces of either fixed or variable dimensions, and one or more vehicle transporters used to move vehicles from the one or more transfer rooms to the plurality of parking spaces. The one or more vehicle transporters are in turn each preferably comprised of one or more vertical stabilizers, one or more tractors, one or more lifts, a lifting platform, and a dolly. The vehicle transporters move the lifting platform and dolly so that the dolly may be positioned to access a vehicle located in a transfer room or parking space. The lifting platform in turn carries the dolly and, in a preferred embodiment, also carries a rotary table suitable for rotating the dolly and a tilting mechanism.

The dolly of the present invention provides an apparatus for engaging and moving a vehicle such that the vehicle may be lifted and lowered vertically so that the vehicle tires may be disengaged from the parking space or transfer room floor, and moved linearly on and off the platform. In one or more alternate embodiments, the present invention may also provide the functions of tilting either the dolly and/or lifting platform relative to a horizontal axis, rotating around a vertical axis, and/or skewing relative to a vertical axis. Furthermore, a combination of the described motions may be carried out simultaneously.

In another aspect, the vehicle parking structure may be configured in a number of manners with regard to the orientation of the parking spaces, transfer rooms and vehicle transporters. In particular, in an embodiment in which a vehicle transporter has a direction of horizontal travel, the vehicle parking structure may be constructed with parking spaces arrayed on one or more sides of the vehicle transporter perpendicular to the direction of horizontal travel. By providing a bi-directional dolly which can load and offload vehicles on one or more sides of the vehicle transporter, the vehicle parking structure of the present invention offers operators greater flexibility in the design and implementation of the structure.

In a preferred embodiment of the present invention having at least two vehicle transporters, the vehicle transporters are designed such that the vehicle transporters operate independently and each is able to reach and service each of the vehicle transfer rooms and each of the plurality of parking spaces. This offers an advantage in that, if one of the vehicle transporters ceases to function, either through breakdown or for scheduled maintenance, at least one other vehicle transporter will remain able to place and/or retrieve vehicles to or from any parking space in the vehicle parking structure. Of course, an arrangement wherein an out-of-service vehicle transporter blocks at least one vehicle transfer room and/or some number of parking spaces would not deviate from the scope of the present invention.

In another aspect of the present invention, the vertical stabilizer is a substantially rigid mast or masts to which the lifting platform may be operably connected, or, alternatively, the vertical stabilizer may constitute one or more generally flexible guides such as cables. Whether the vertical stabilizer is substantially rigid or generally flexible, in the apparatus of the present invention, the vertical stabilizer may be expandable such that if additional vertical levels of parking spaces are added, the vertical stabilizer may expand to accommodate the additional vertical lift necessary.

In another aspect of the present invention, the vertical stabilizer may engage the vehicle parking structure in a number of manners. For example, the vertical stabilizer may be constructed such that it hangs from the parking structure. In this embodiment, the weight of the vertical stabilizer, the lifting platform, the vehicle and any additional elements is suspended from the structure. Alternatively, the vertical stabilizer may be supported by the floor of the structure, or otherwise support its own weight along with the weight of the lifting platform, the vehicle and additional elements. In this later embodiment, the vertical stabilizer must be better able to withstand the compressive forces associated with supporting the given weights.

Furthermore, in various alternate embodiments, tractors, which are operably connected with the one or more vertical stabilizers and/or a framework employed to interconnect a plurality of vertical stabilizers and which provide motion to the one or more vehicle transporters, may take any of a number of forms. For example, the tractors may constitute a motorized wheel assembly fixedly mounted to either the top end, bottom end, or both ends of the vertical stabilizer. In an embodiment in which multiple tractors are employed on a single vehicle transporter, it is preferred to incorporate a synchronizer such as a shaft, chain, belt or electronic controllers to ensure that the multiple tractors remain synchronized to reduce the possibility of inducing bending stresses in the one or more vertical stabilizers caused by unequal movements of the multiple tractors. Alternatively, in an embodiment which does not utilize a synchronizer to coordinate the tractors, a relatively more rigid connection between the one or more vertical stabilizers and the tractors may be required. In yet another embodiment, the tractors may not be fixedly mounted to the one or more vehicle transporters, but may take the form of fixed motors mounted within the vehicle parking structure and operably engaged with the vehicle transporters through a system of cables, chains or the like. In another aspect, a series of tracks, rails or guides may be provided within the vehicle parking structure on or in which the vehicle transporter may travel to reduce the likelihood of the vehicle transporter traveling in a non-linear fashion, or of traveling in direction which is not substantially perpendicular to the longer dimension of the individual parking spaces which comprise the plurality of parking spaces.

In another embodiment, one or more winches are provided to raise and lower the lifting platform, with or without the vehicle, in the vertical direction, such as to transfer the lifting platform, with or without the vehicle, from one of the vehicle transfer rooms to one of the plurality of parking spaces. The winches may be mounted in any number of locations, such as integral with the lifting platform, or mounted to one of the tractors, depending on where the lifting loads are to be borne. It should be noted that although the term winch is used to describe the lifting apparatus, this term should not be limited to the conventional cable-over-drum arrangement. Any mechanism for providing lift to the lifting platform should be considered within the scope of the term winch.

In yet another aspect of the present invention, electrical power may be provided to the vehicle transporters via a series of cables. Alternatively, to eliminate the problems associated with the use of cables, such as the cables becoming tangled with the vehicle transporters or any other structure or other cabling in the vehicle parking structure, a power rail system comprising at least one power rail may be employed. The use of a power rail system provides an additional benefit in that, by terminating the power rail at a location beyond which it is not desirable to allow the vehicle transporters to travel, it is possible to prevent the vehicle transporters from over-traveling and colliding with either the vehicle parking structure itself, or with another vehicle transporter.

In yet another aspect of the present invention, a dolly may be provided to engage a vehicle and to move it between one of the vehicle transfer rooms and the lifting platform, and between the lifting platform and one of the plurality of parking spaces. In a preferred embodiment, the dolly is dimensioned such that it may be inserted under a vehicle and between the vehicle's tires without damaging the vehicle. Unlike previous automated parking structures, however, the dolly of the present invention is dimensioned so as to have a height which is less than the space between the surface on which the vehicle is resting (such as the floor of the transfer room or parking space) and the vehicle body, known as the vehicle ground clearance. Because of this design, the floors of the transfer rooms and parking spaces of the present invention need not be specially constructed to accommodate the dolly.

Once inserted under the vehicle, the dolly may deploy a number of tire engagement arms suitable for engaging the tires of a vehicle. Once the tires have been engaged, the dolly lifts the vehicle such that the vehicle tires are no longer in contact with the floor of a vehicle transfer room or parking space. Once the vehicle has been lifted, it may be moved between one of the vehicle transfer rooms and the lifting platform and/or between the lifting platform and one of the parking spaces. Furthermore, as described above, the dolly may be deployed from multiple sides of the vehicle transporter, allowing the dolly to access vehicles at multiple orientations relative to the vehicle transporter.

The tire engagement arms, which are deployed in pairs for each tire, may lift the vehicle by any of a number of methods. For example, each tire engagement arm may move towards its paired tire engagement arm, squeezing under the lower portion of a tire, thereby lifting that tire from the floor. Alternatively, a pair of arms may remain engaged with the underside of the tire, yet stationary with respect to the tire, and may lift vertically thereby raising the tire from the floor.

In another aspect of the present invention, the dolly may be comprised of a substantially rigid spine, and first and second slidable sections, with each slidable section carrying two pairs of tire engagement arms and deployable such that the tire engagement arms may engage a pair of tires associated with a single vehicle axle. Once each slidable section has reached a required position, dependant on the distance between the front and rear vehicle tires, at which the arms are correctly positioned to engage the tires associated with a single vehicle axle, the slidable sections are locked into place. In a preferred embodiment of the present invention, the first and second slidable sections are set to a desired position corresponding to the wheelbase of a vehicle to be engaged prior to insertion under the vehicle and advantageously while the transporter is moving to the location at which it will engage the vehicle. By presetting the relative position of the first and second slidable sections, economy of motion and time may be achieved as the apparatus need not determine the correct position for the slidable sections as a separate, subsequent step. Furthermore, each of the slidable sections may be independently operated and may be skewed relative to the central axis of the dolly, allowing the dolly to be steered.

In various alternate embodiments, the vehicle parking structure may include guides for the dolly for the purpose of controlling travel of the dolly. For example, the vehicle parking structure may employ as a guide a series of grooves, magnetic tape, or chemical signals associated with the floor of the one or more vehicle transfer rooms and the plurality of parking spaces, which guide may be readable by the dolly. Each slidable section may also comprise one or more collision detectors, thereby allowing each slidable section to halt if a collision with an object is detected.

In an alternate embodiment, the dolly may be configured such that it passes outside the vehicle tires, thereby eliminating the need to fit under the vehicle. In this embodiment the tire engagement arms are initially disposed outside the vehicle wheels and when extended, pass under the vehicle to engage the tires.

In additional aspects of the present invention, the vehicle parking structure may also comprise a vehicle measuring and inspection system. The vehicle measuring and inspection system may perform any one or a combination of functions such as measuring the overall length, width, height, ground clearance and/or weight of a vehicle to be parked and ensuring that the dimensions of the vehicle fall within a pre-determined set of dimension guidelines; determining the position of the vehicle in the vehicle transfer room; determining if the vehicle includes any appendages which may adversely affect parking the vehicle; and measuring the wheelbase of the vehicle so that the dolly may adjust to the correct separation for the tires of the vehicle before the transporter reaches the vehicle. The vehicle measuring and inspection system may operate automatically using any of a number of technologies. For example, sensors and detectors employing any one of a number of electromagnetic frequencies may detect and measure the required dimensions of the vehicle. In a preferred embodiment, the sensors and detectors may comprise an array of laser scanners employing time of flight measuring technology to measure the vehicle and establish its position in the transfer room. The vehicle measuring and inspection system may also employ thermographic cameras to detect unusual heat sources and/or scales to detect unusual weight shifts within a vehicle, either possibly indicating that the vehicle is occupied; or a manual inspection and measuring of the vehicle may fulfill these functions. It should be noted that the vehicle measuring and inspection system and/or the parking management system discussed below, may also include sensors for recognizing a known vehicle, or known vehicle make and/or model such as would be encountered in a residential setting where tenants' vehicles would be registered with the system, and thereafter modifying or eliminating the vehicle measuring and inspection steps based on information known about the subject vehicle.

In an additional aspect of the present invention, the vehicle parking structure may also comprise a parking management system. The parking management system may include any one or a combination of functions such as accepting customer requests to return a vehicle; alerting a customer when a vehicle has been returned; offering a customer one or more specific times or a range of times when a vehicle is to be returned and accepting a customer response; monitoring the position and status of each of the one or more vehicle transporters; automatically moving to improve the efficiency of the parking structure such as by moving vehicles from remote parking spaces to spaces closer to the vehicle transfer rooms such that retrieval time is lessened once the vehicle is requested; providing one or more operational modes such as setup, maintenance, normal operation and emergency, including a vehicle fire mode in which a vehicle which is, or is suspected of being, on fire may be moved to a specific fire suppression area or otherwise removed from the parking structure; storing data regarding specific vehicles such that when a vehicle identification is received, either wirelessly or through some other method, the system may be able to implement certain functions such as presetting the dolly; and receiving vehicle measurement and position data from the vehicle measuring system, and thereafter adjusting the vehicle dolly accordingly and/or assigning vehicles to specific parking spaces according to the size of the vehicle and the size of the available parking spaces.

In yet another aspect of the present invention, the parking management system may also include functionality allowing the parking management system to map the parking structure. In particular, the parking management system may adaptively learn the physical characteristics of the parking structure through interaction with the structure. For example, during a set up process, an operator may program the parking management system to define certain physical characteristics of the parking structure, for example, the number of parking spaces and transfer rooms, the physical dimensions of each parking space and transfer room, the location of any obstructions that may block a parking operation, and/or any other characteristics that may be noteworthy in the parking operation. Following the initial set up process, during a verification step, the operator or parking management system may instruct one or more of the vehicle transporters to travel to a specific location within the parking structure. Once at the specific location, the vehicle transporter may engage an indexing marker, such as a beacon, transponder, reflector or the like, and, based on the vehicle transporter's actual location when engaging the indexing marker, the parking management system may adjust the data representing the physical characteristics of the parking structure previously programmed during the initial set up process. In other words, the parking management system may compare an expected location of the indexing marker based on programmed data against the indexing marker's actual location and/or the location of the vehicle transporter when it recognizes the indexing marker and thereby identify any discrepancy with the programmed data. The parking management system may then continue to operate based on the programmed data, or may operate based on the new data received in the verification step.

By mapping the parking structure based on both programmed data and verified data, the parking management system may compensate for at least two areas of error. First, the parking management system may identify errors in the programmed data entered in the set up process. Second, the parking management system may identify gradual variations in the parking structure or the vehicle transporters which may accrue over time. Specifically, changes in the physical characteristics of the parking structure occurring due to, for example, settling of the structure over time, and/or expansion and contraction due to thermal changes may be recognized and compensated for. Additionally, changes in the vehicle transporters due to, for example, component wear, and/or stretching of cables, chains and the like, may be recognized and compensated for by the parking management system.

It should be noted that the parking management system may perform the verification step at any time during operation, and the parking structure may include any number of indexing markers. Thus, the parking management system may continuously verify the location of the vehicle transporters relative to known locations within the parking structure and adjust its operation accordingly.

In yet additional aspects of the present invention, the vehicle parking structure may also comprise a vehicle occupant detection system which may use systems such as thermal imaging, motion detectors, and or other detectors to identify vehicles which may be occupied, such as by a child or a pet, and which are therefore unsuitable for parking.

Furthermore, the vehicle parking structure may also comprise an appendage detection system suitable for detecting if a vehicle appendage such as a door, hatchback, trunk lid, hood, or tailgate has been left open, or if the vehicle has, e.g. bike racks, antennae or other appendages that may adversely impact the parking process. As movement of a vehicle with an unexpected appendage may cause damage to the vehicle, other vehicles within the parking structure, and/or vehicle parking structure itself, the system restricts movement of such a vehicle. In an alternate embodiment, the appendage detection system may also include an appendage restraint system which may act to prevent damage to the vehicle or vehicle parking structure in the event that a vehicle is moved with one or more appendages.

The present invention may also include an alignment/level maintenance device whereby the lifting platform may engage the vehicle parking structure to ensure that the lifting platform remain adjacent to/level with a parking space while a vehicle is being loaded or offloaded. Finally, the vehicle parking structure may also include one or more maintenance vehicles which may or may not operate autonomously or semi-autonomously and are used in the servicing of various elements of the vehicle parking structure and may also incorporate fire suppression technologies.

BRIEF DESCRIPTIONS OF THE DRAWINGS

The invention will be better understood with reference to the drawings taken in connection with the detailed description which follows.

Figure 3A:
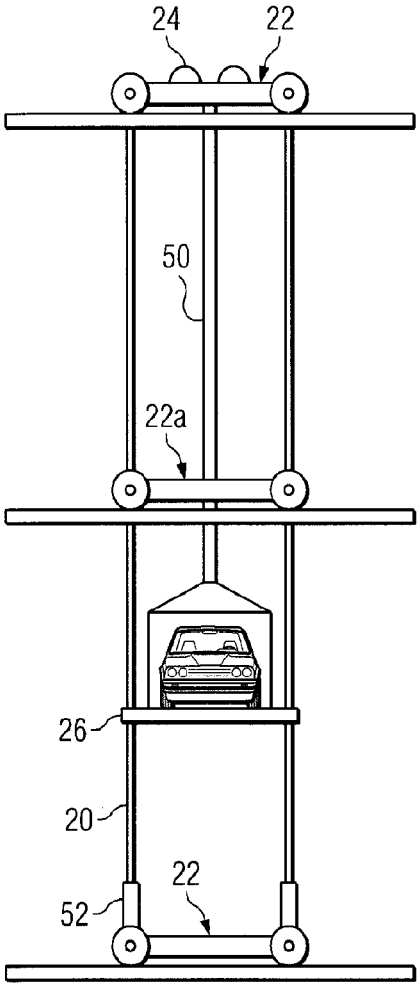
Figure 3B:
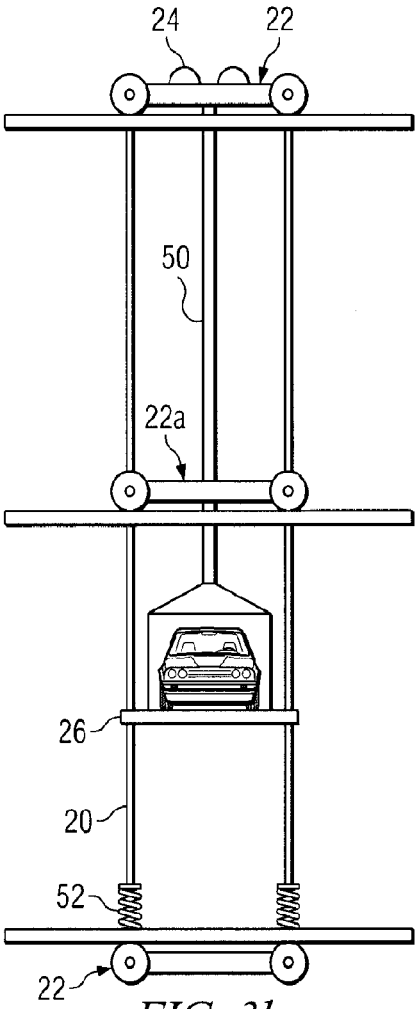
Figure 3C:
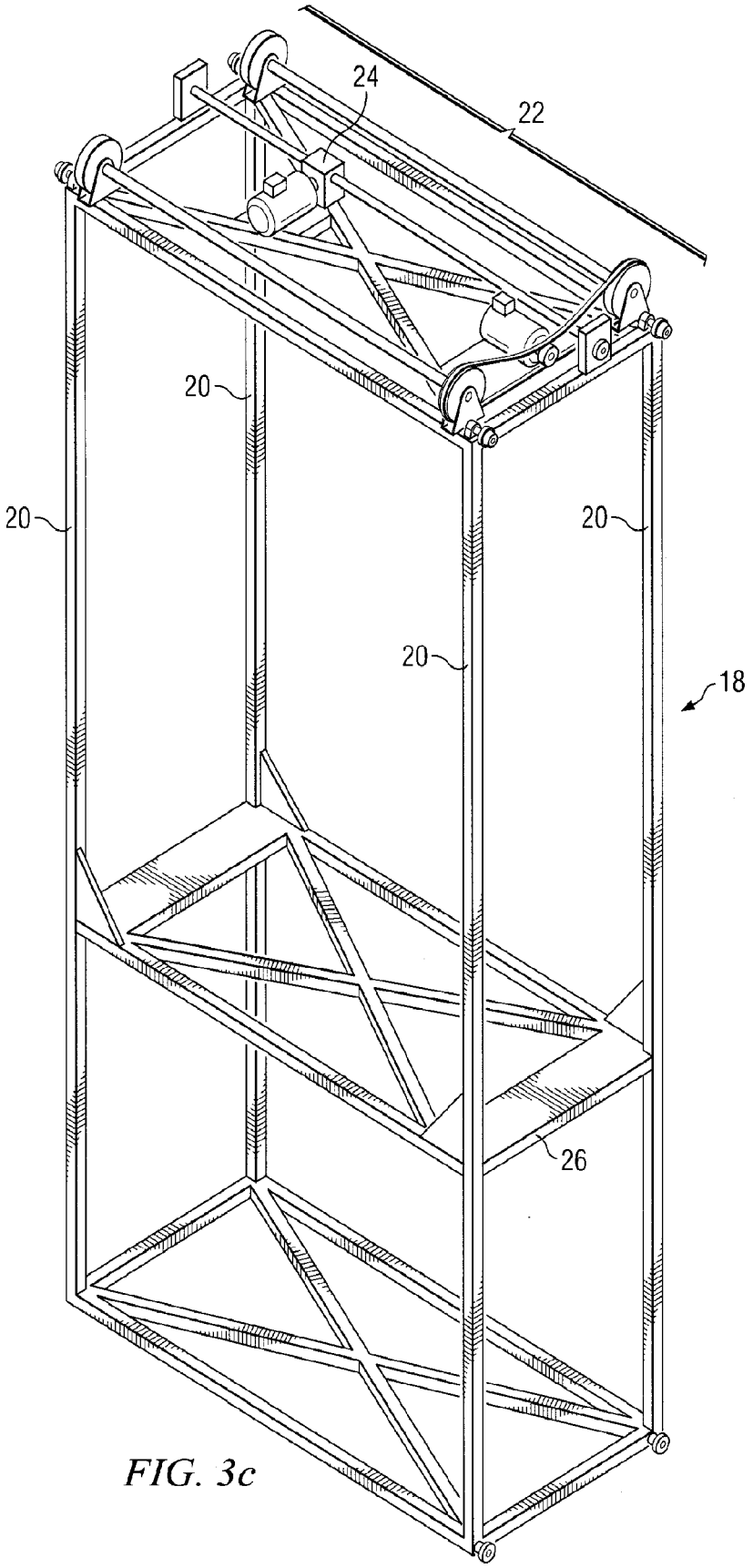
Figure 4:
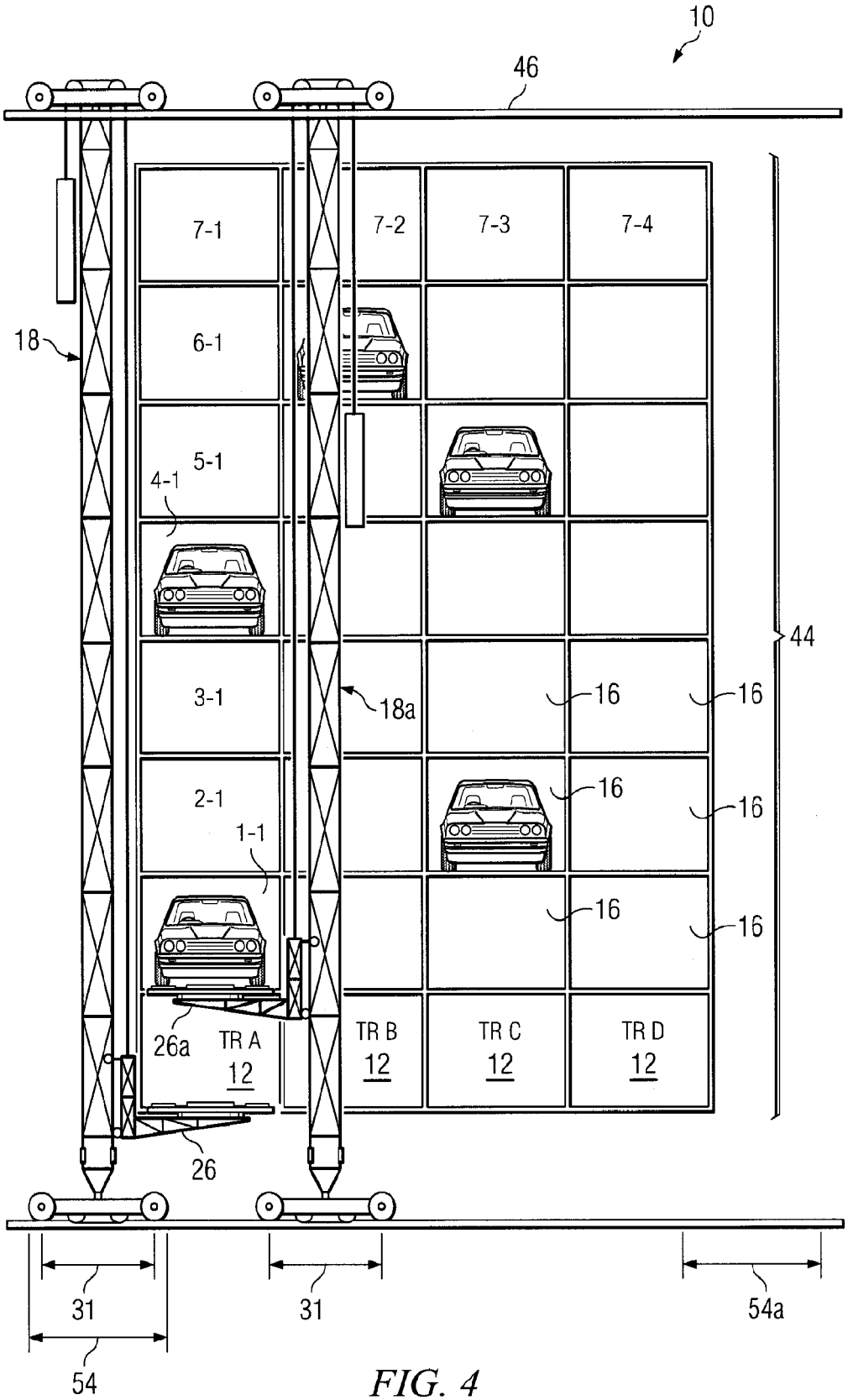
Figure 5:
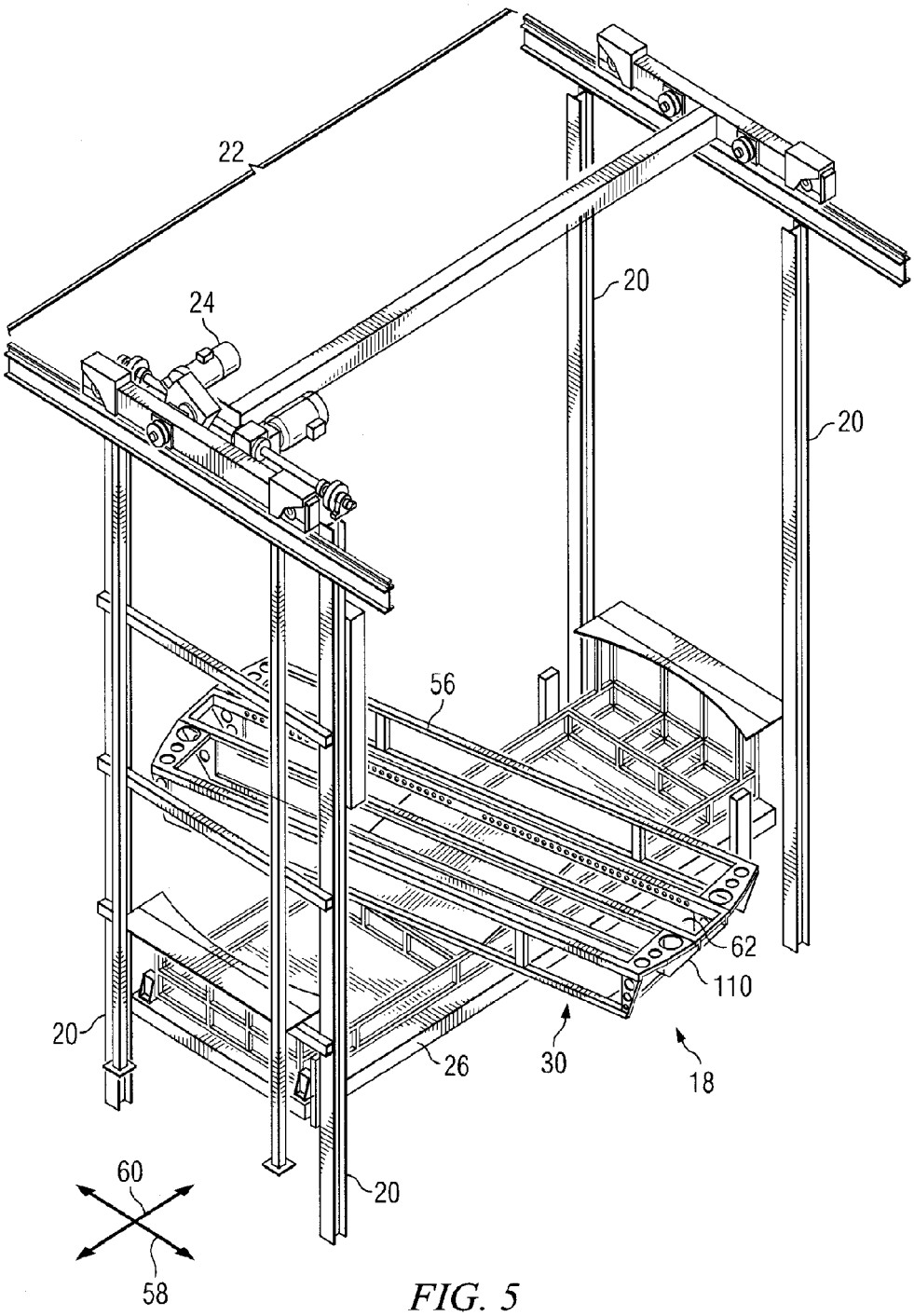
Figure 6:
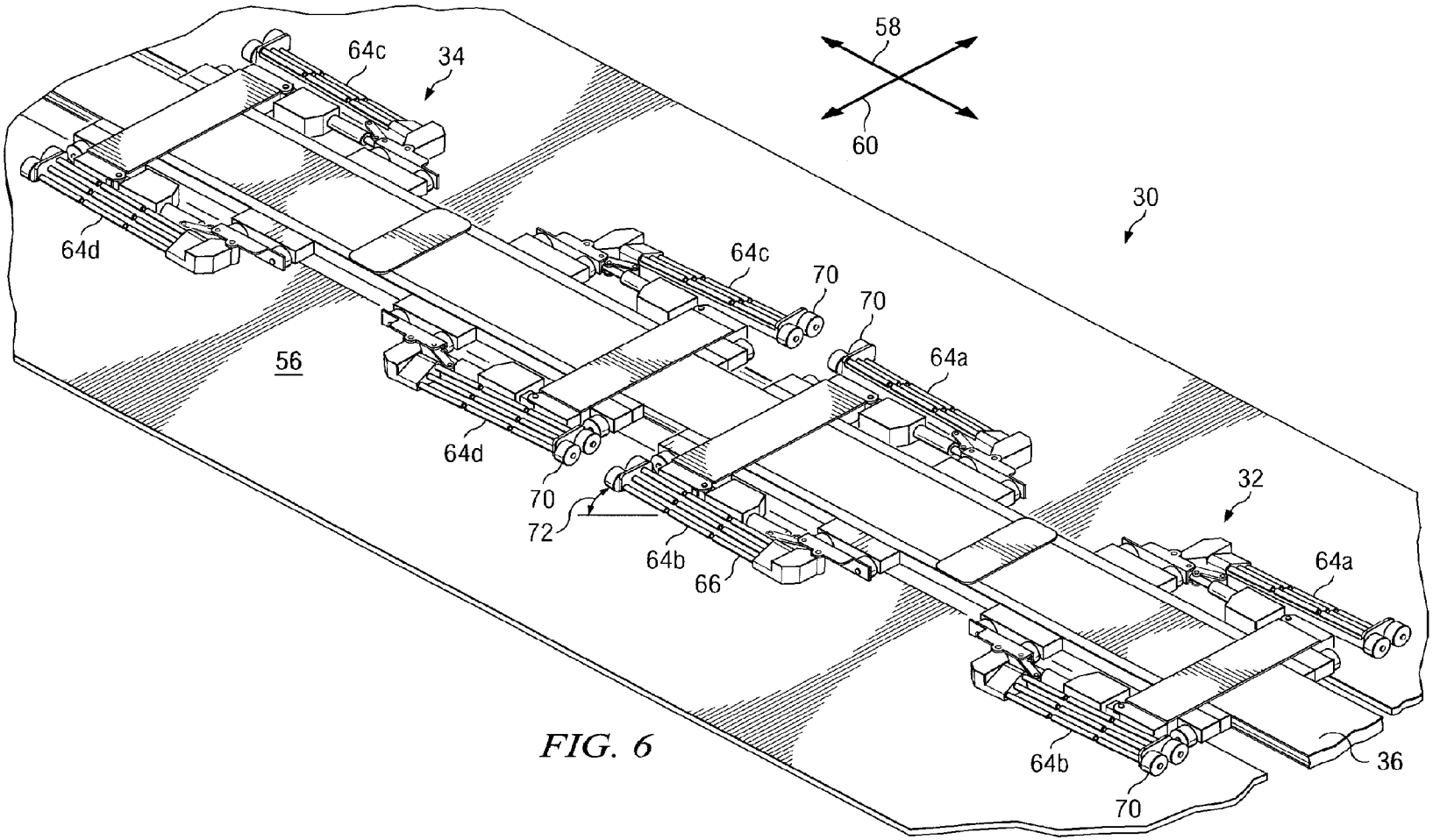
Figure 7:
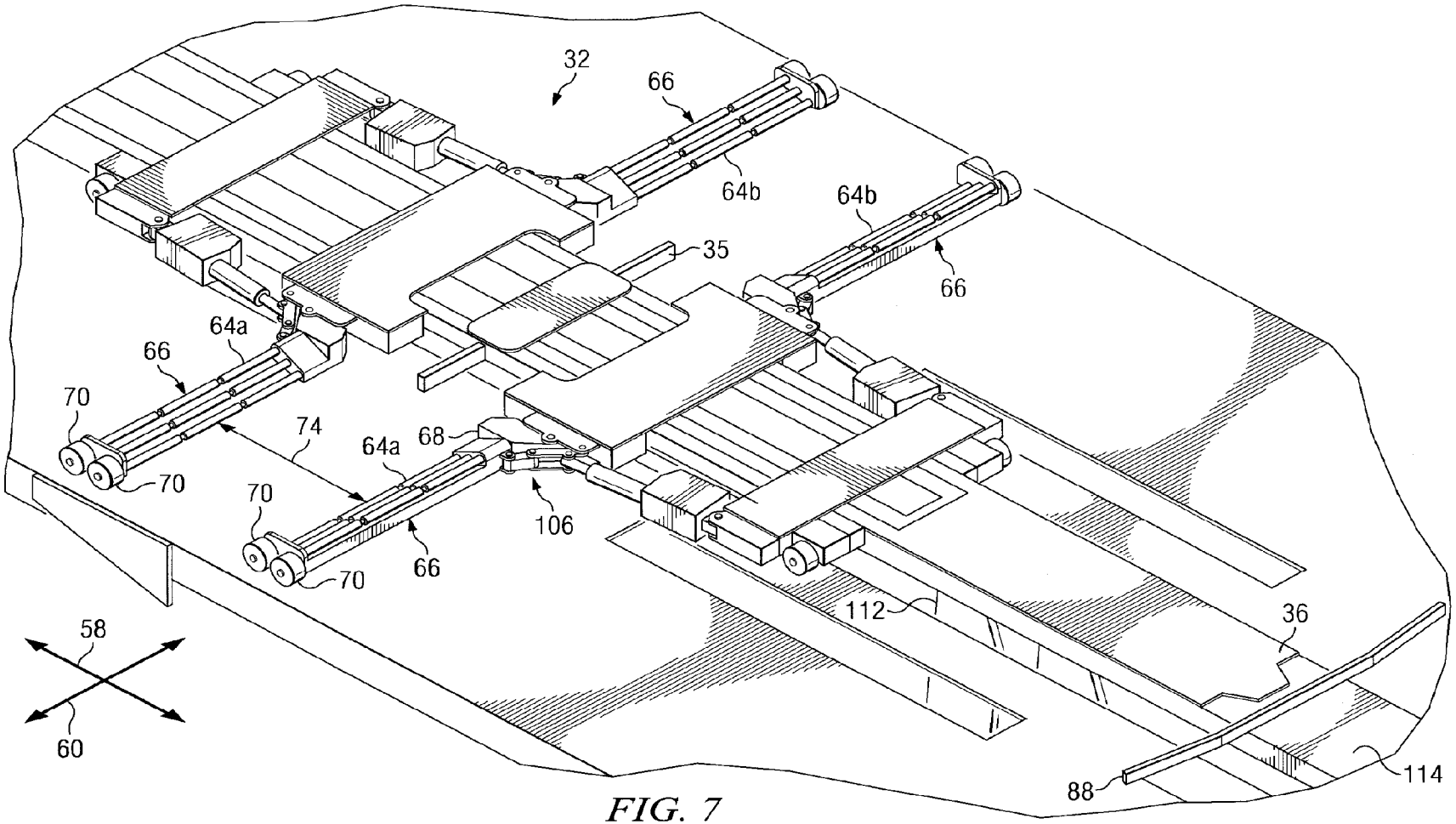
Figure 8:
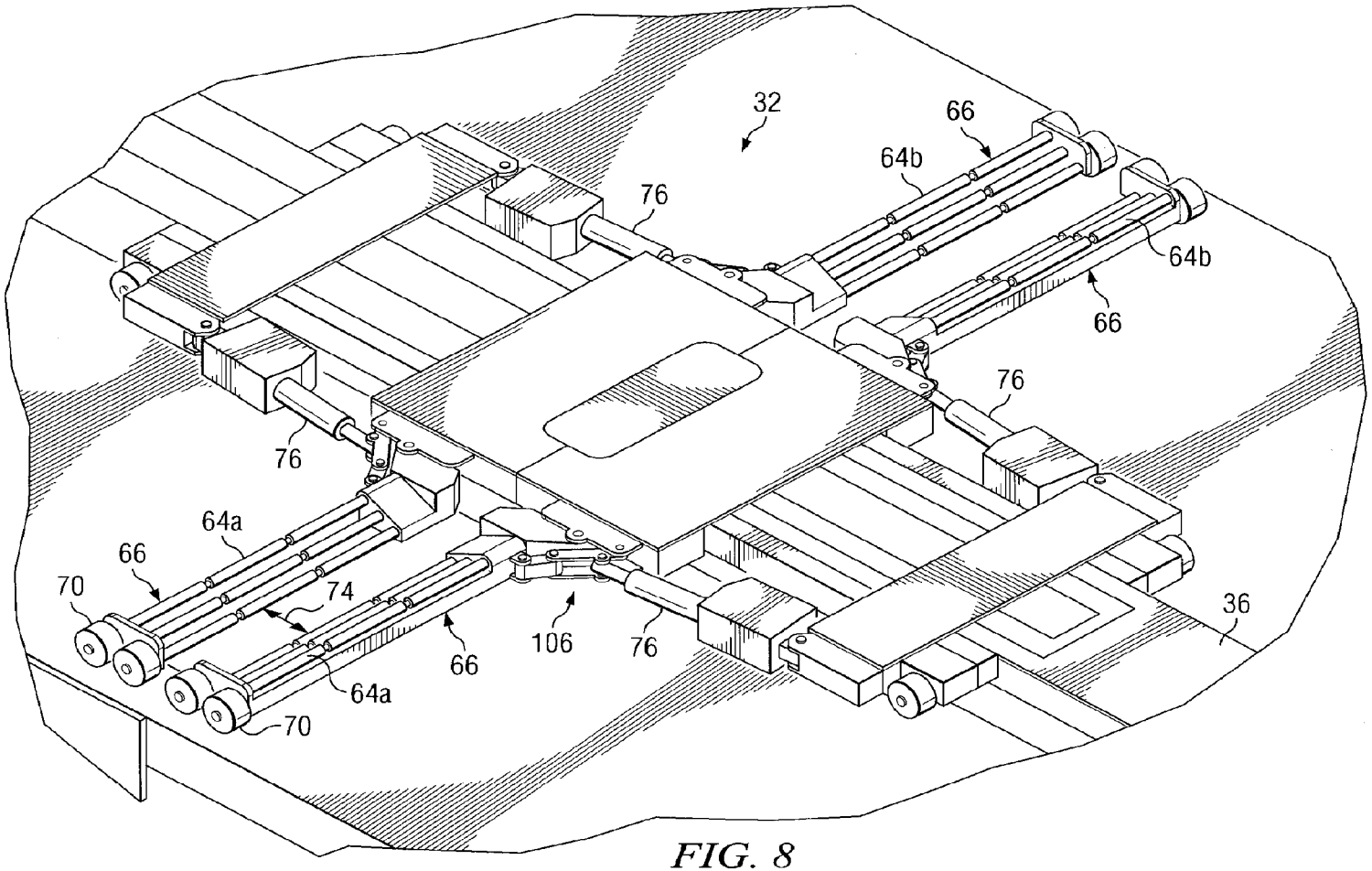
Figure 9:
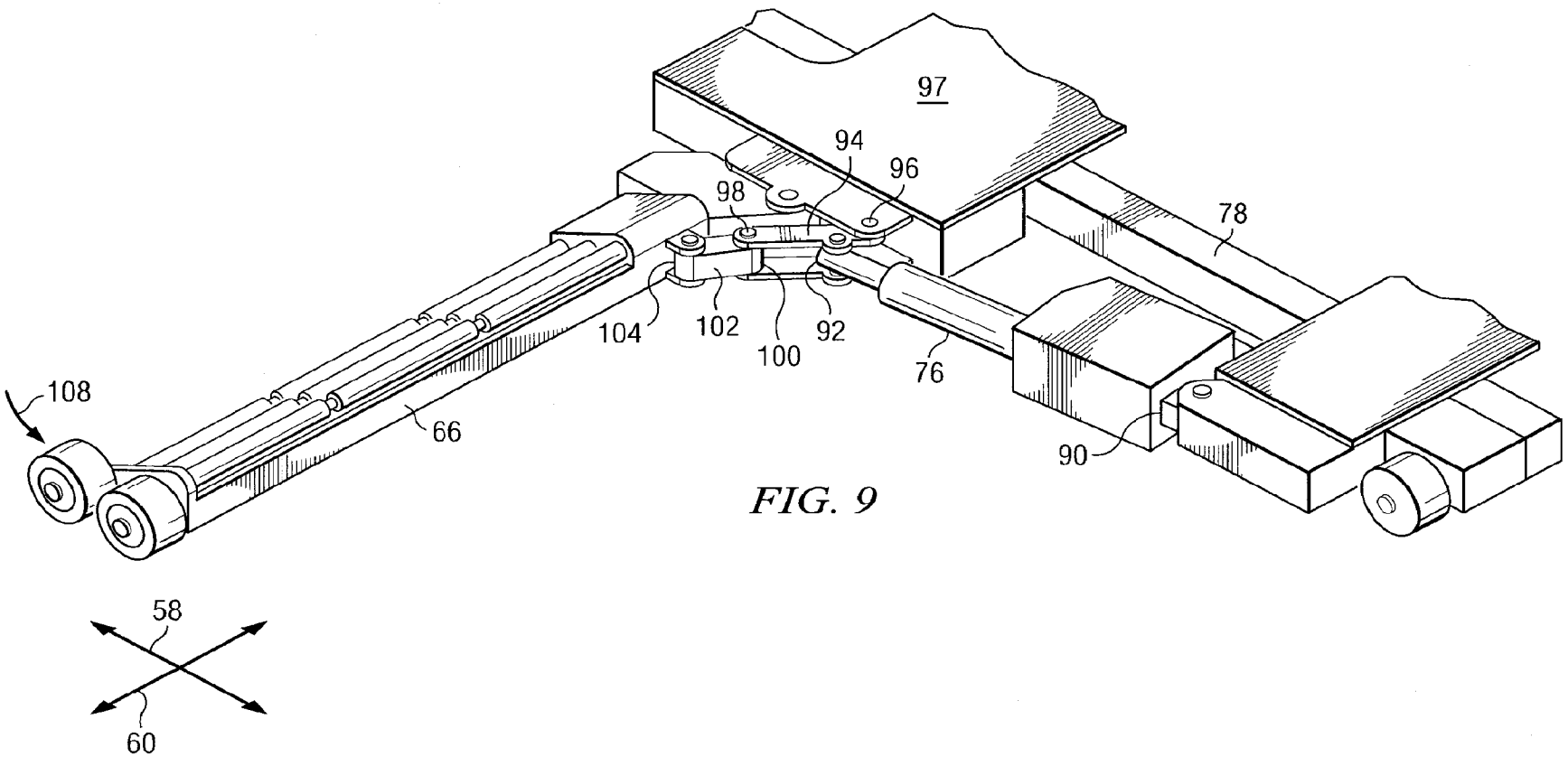
Figure 10:
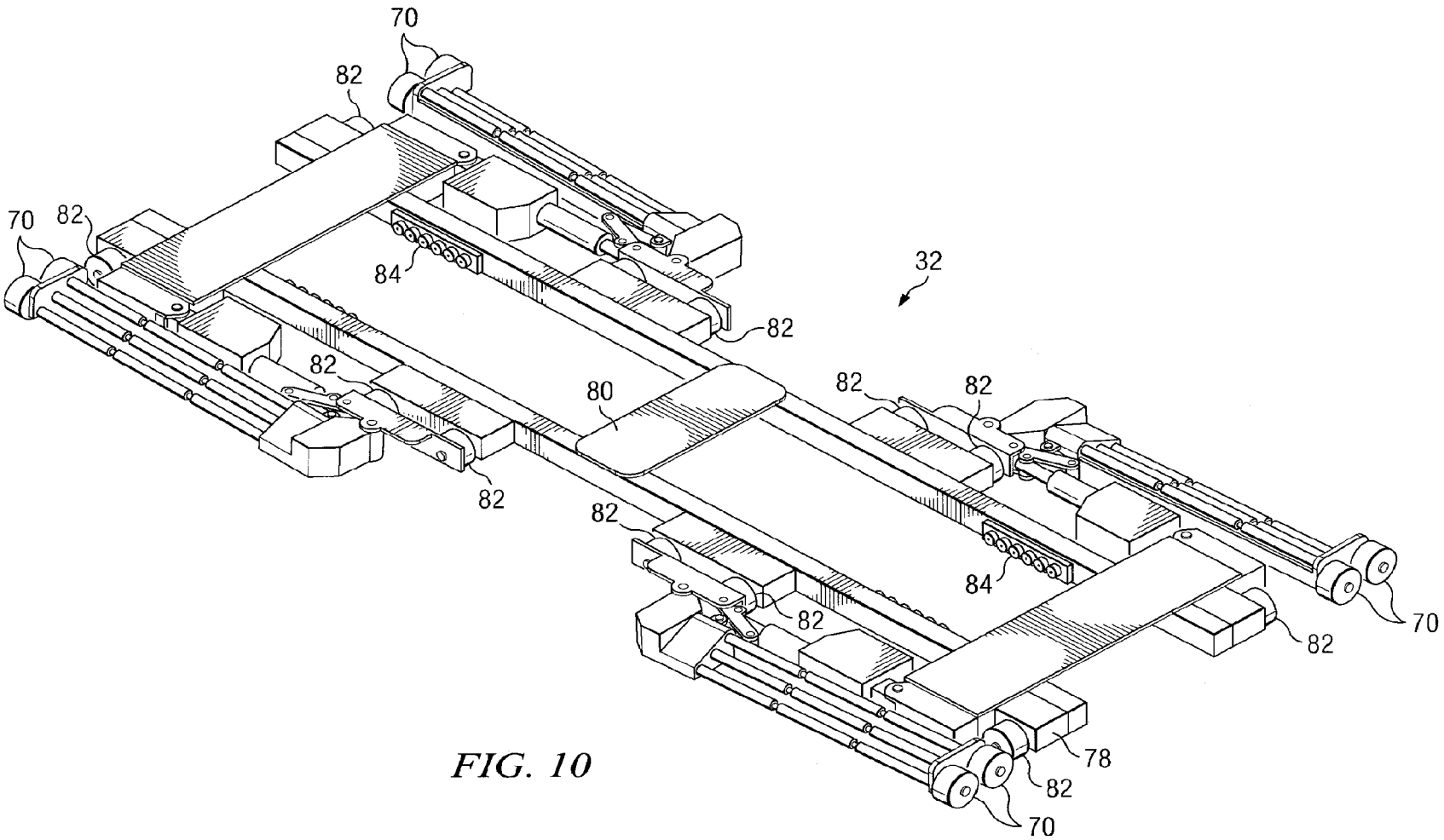
Figure 11:
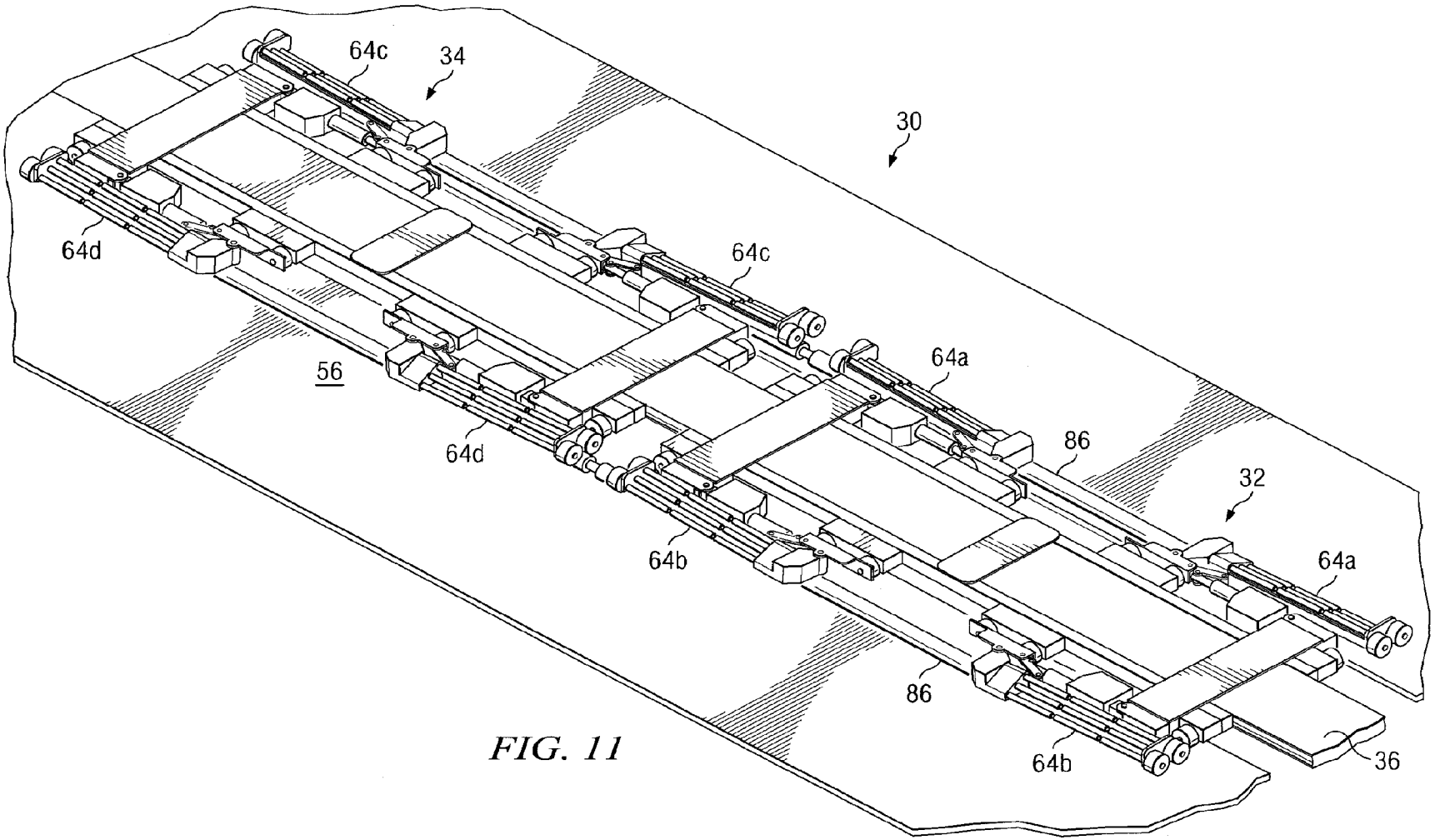
Figure 12:
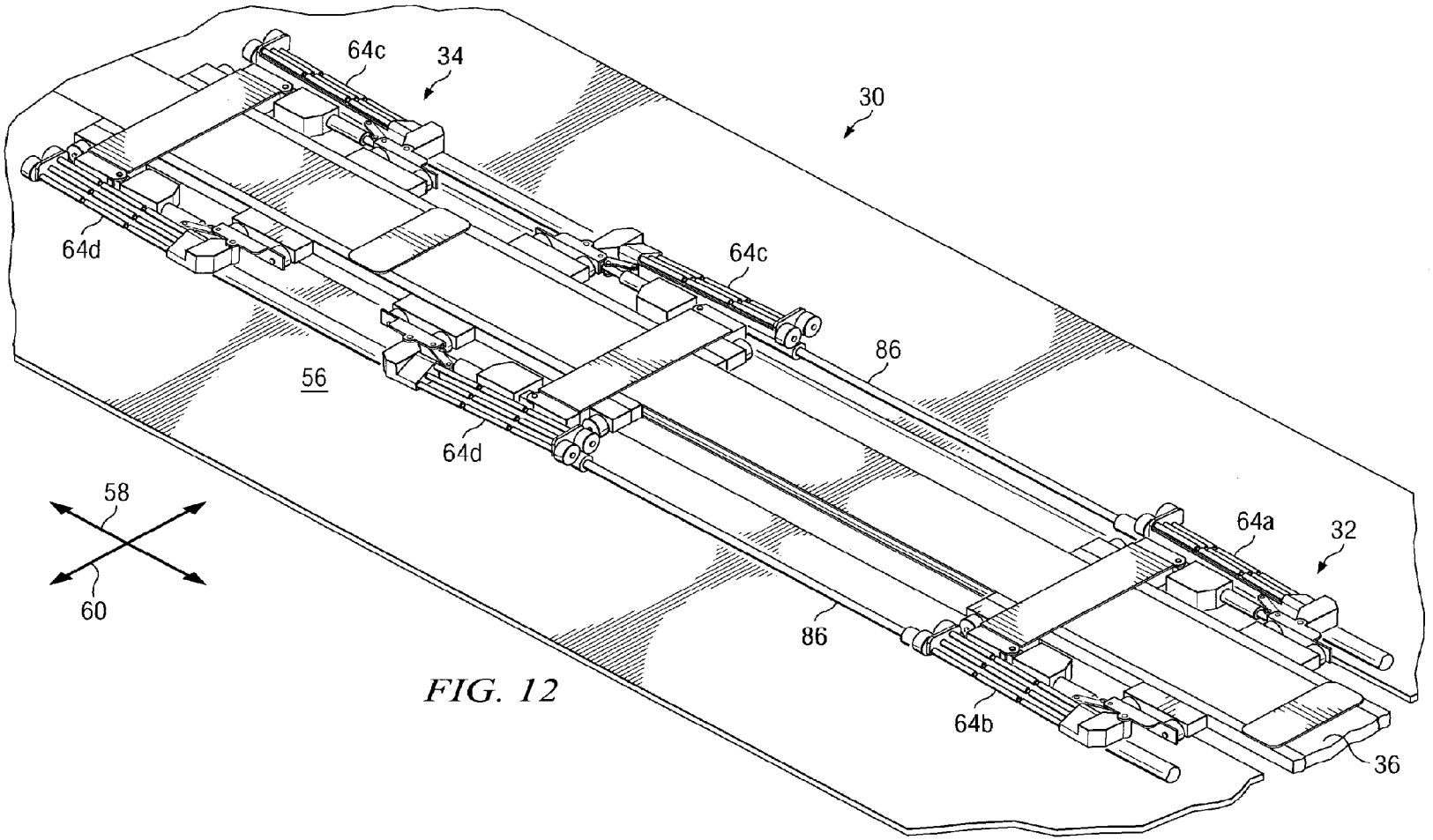
Figure 13:
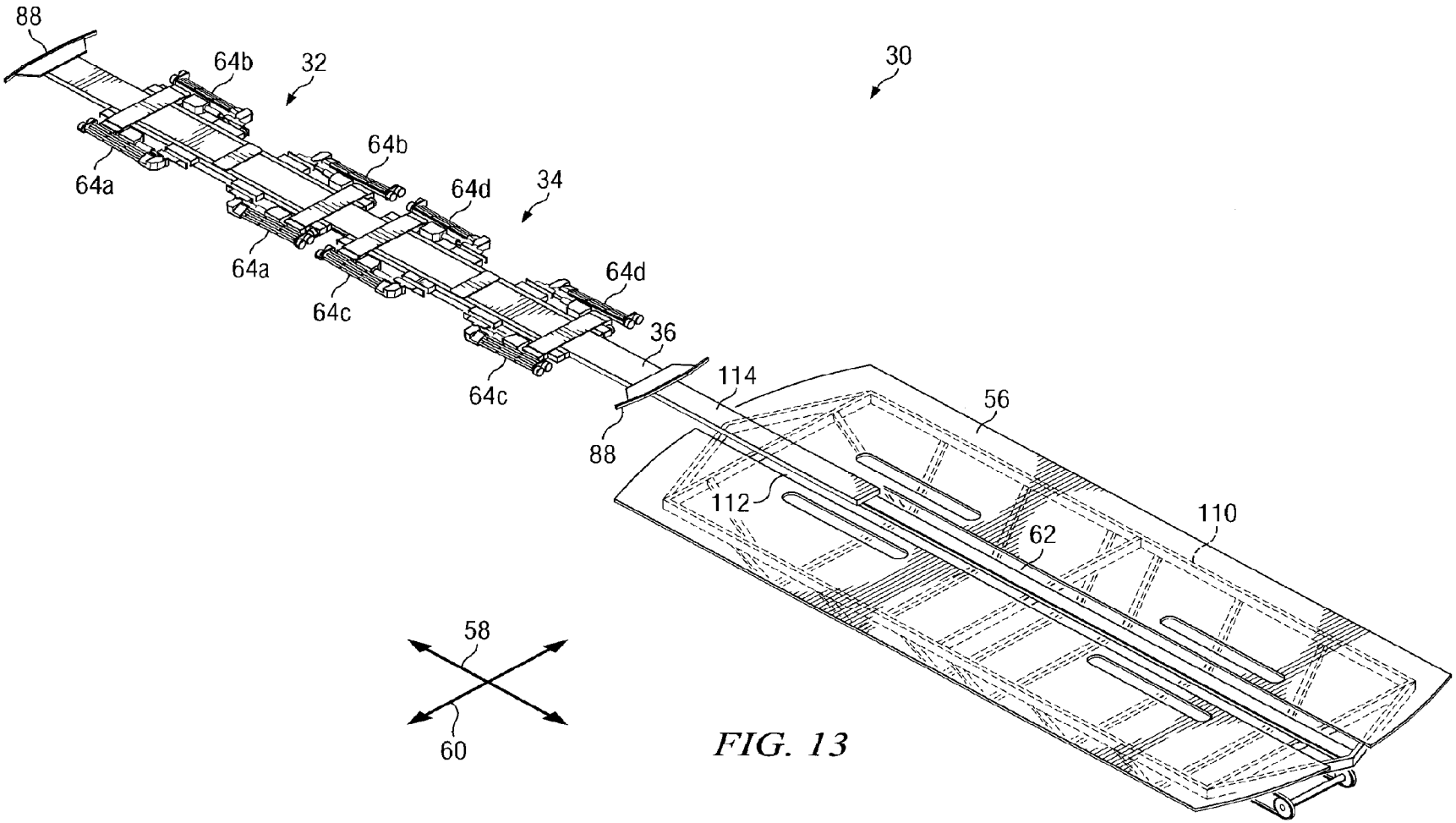
Figure 14:
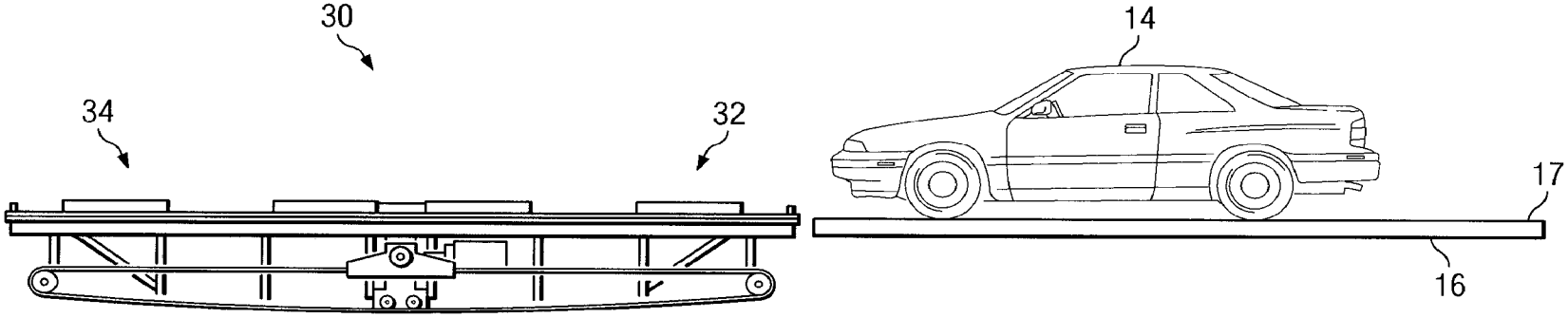
Figure 14A:
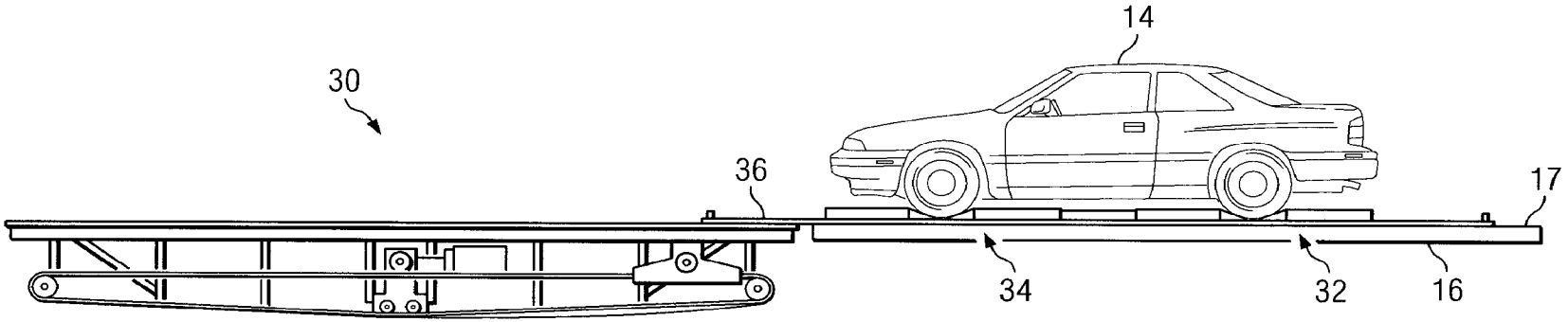
Figure 15:
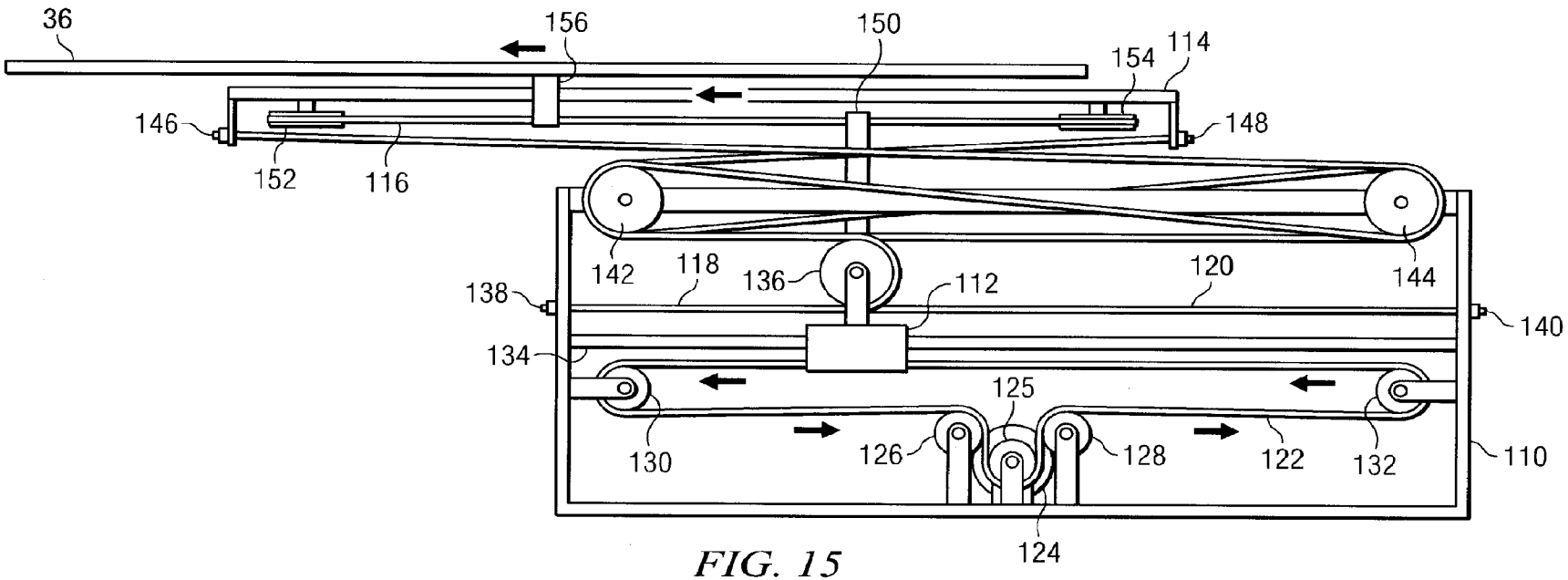
Figure 16:
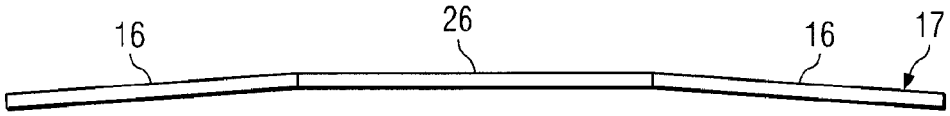
Figure 17:
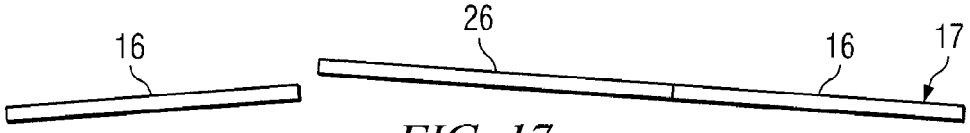
Figure 18:
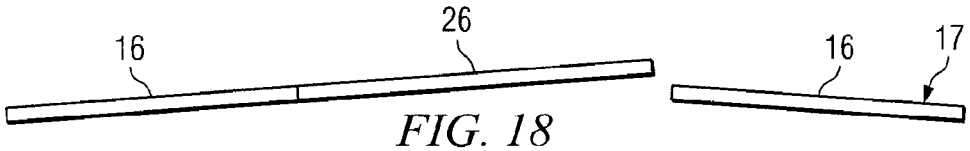
Figure 19:
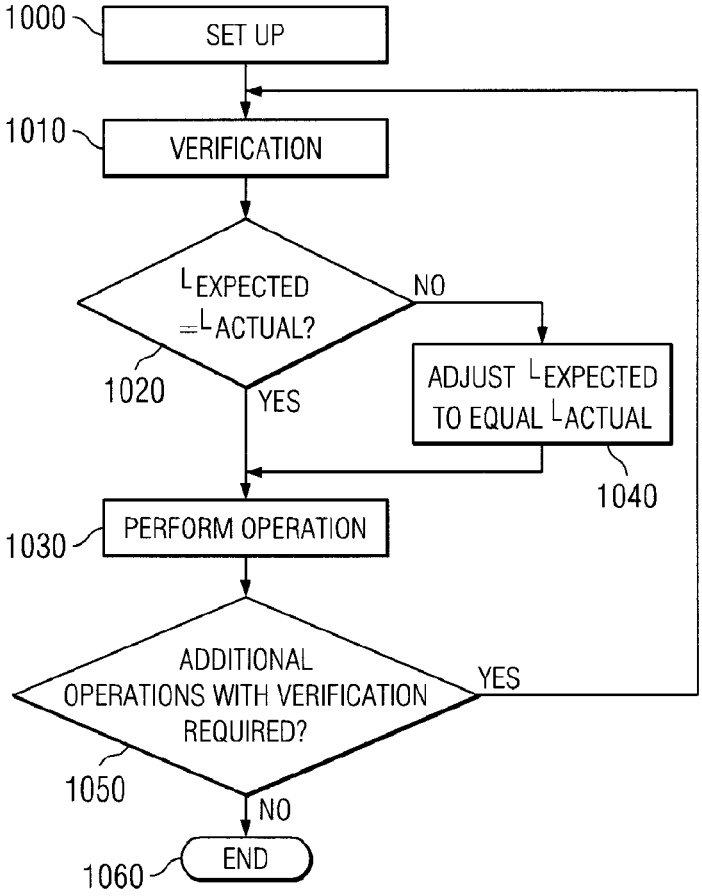

FIG. 3*a* shows an alternative embodiment of the present invention with shafts or cables replacing the mast;

FIG. 3*b* shows one embodiment of a vertical stabilizer utilizing a four post design;

FIG. 3*c* shows one embodiment of a vertical stabilizer utilizing a four post design;

FIG. 4 shows one embodiment of a parking structure of the present invention with two vehicle transporters able to service all the parking spaces;

FIG. 5 shows one embodiment of a lifting platform and dolly of the present invention;

FIG. 6 shows one embodiment of the dolly of the present invention with the tire engagement arms in the closed position;

FIG. 7 shows one embodiment of the dolly of the present invention with the tire engagement arms in the extended position;

FIG. 8 shows one embodiment of the dolly of the present invention with the tire engagement arms in the extended and pinched position;

FIG. 9 shows one embodiment of the dolly of the present invention, specifically a mechanical linkage responsible for extending the tire engagement arms;

FIG. 10 shows one embodiment of one of the slidable sections which, in part, comprise the dolly;

FIG. 11 shows one embodiment of the dolly of the present invention with the first and second slidable sections in a starting position;

FIG. 12 shows one embodiment of the dolly of the present invention with the first and second slidable sections in an open position;

FIG. 13 depicts one embodiment of the dolly and lifting platform in which the dolly has been deployed from a lifting platform;

FIG. 14 depicts a lifting platform and dolly with the dolly retracted;

FIG. 14*a* depicts a lifting platform and dolly with the dolly extended under a vehicle;

FIG. 15 is a schematic view of a push/pull mechanism associated with a dolly;

FIGS. 16-18 depict the operation of a tilt mechanism of the present invention enabling a lifting platform to access parking spaces positioned on multiple sides of the lifting platform;

FIG. 19 depicts a flowchart representing the operation of a parking structure mapping operation of the present invention.

DETAILED DESCRIPTION OF THE INVENTION

Figure 1:
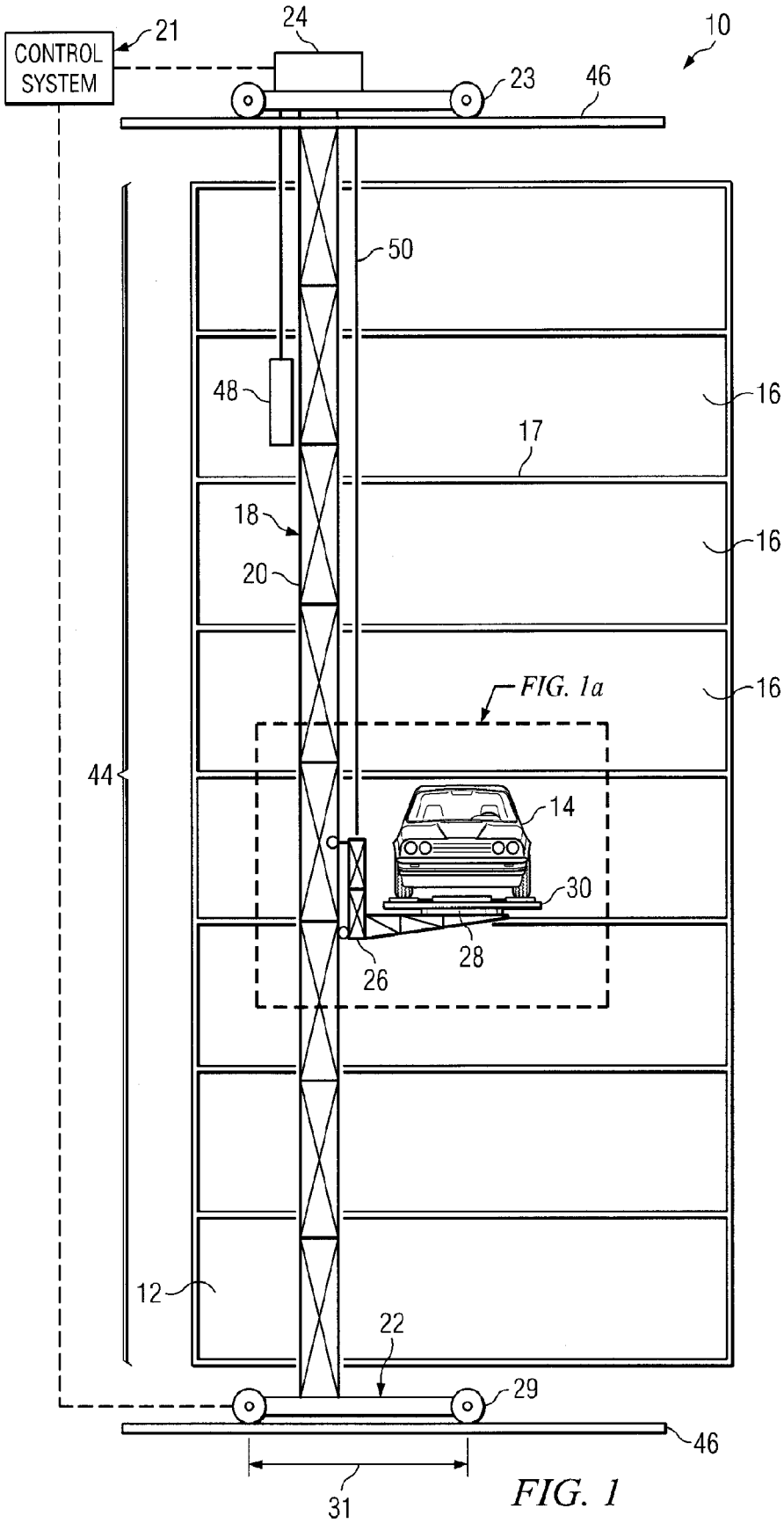
FIG. 1 is a schematic of the vehicle parking structure of the present invention.
Figure 1A:
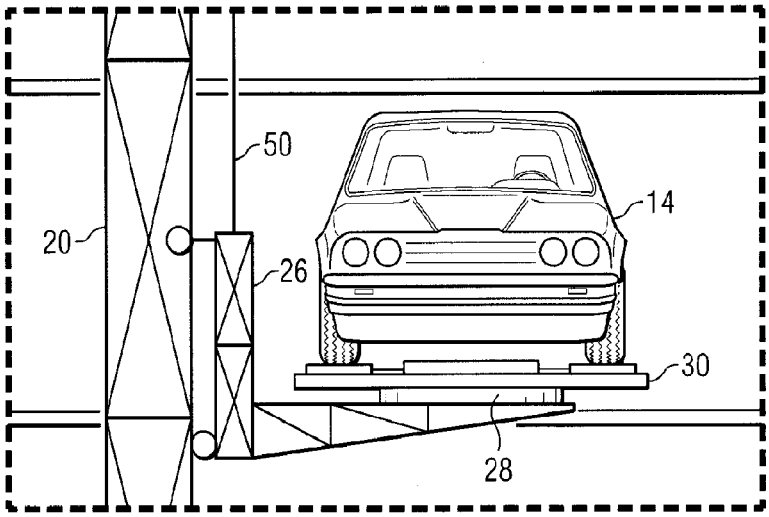
FIG. 1A is a close up of certain elements depicted in FIG. 1.

FIGS. 1 and 1A, depict a section of the interior of vehicle parking structure 10 of the present invention. The parking structure 10 comprises at least one vehicle transfer room 12 and a plurality of parking spaces 16. The parking structure 10 also comprises framework 44 suitable for maintaining the structural integrity of the structure and, in the embodiment depicted in FIG. 1, for dividing the individual parking spaces 16. It should be noted that as depicted, framework 44 does not separate each and every parking space 16. Rather, long horizontal spans are employed, enabling an operator to vary the area allotted for each parking space 16. This embodiment may be preferable in installations wherein the ability to alter the size of each parking space 16 is desired. However, as will be shown if FIGS. 2 and 4, alternate layouts of framework 44 may be employed without departing from the scope of the invention. Finally, it should also be noted that although the figures generally depict an arrangement wherein the parking spaces 16 are placed above the transfer rooms 12, an alternate embodiment wherein the transfer rooms 12 are above the parking spaces 16 (such as if the parking spaces were subterranean), or where the transfer rooms 12 were placed at some intermediate location within the array of parking spaces 16 (such as if the parking spaces 16 were both subterranean and above ground), would not deviate from the scope of the invention.

Within the vehicle parking structure 10, one or more vehicle transporters 18 may operate. In the embodiment depicted in FIG. 1, the vehicle transporter 18 is comprised of vertical stabilizer 20, tractor 22, a set of unpowered guide wheels 23, and as shown in more detail in FIG. 1A, lifting platform 26, winch 24, and dolly 30. The unpowered guide wheels 23 may derive motion from the force transmitted by the vertical stabilizer 20 being moved by the tractor 22, and both the tractor 22 and the unpowered guide wheels 23 may be guided by rails 46. The tractor 22 must have sufficient power and structural strength to move itself, the vertical stabilizer 20 and the unpowered guide wheels 23. The vertical stabilizer 20 must be of sufficient strength to transmit the force required to cause the unpowered guide wheels 23 to move in unison with the tractor 22. The vertical stabilizer 20 must also have sufficient strength to resist bending and to maintain its shape so that the position of the vehicle transporter 18 can be known by the control system 21. Although FIG. 1 depicts the tractor 22 at the bottom of the parking structure 10 and the unpowered guide wheels 23 at the top of the parking structure 10, those positions could be reversed without deviating from the scope of the invention. Furthermore, a system in which the tractor 22 was located at a point intermediate along the vertical stabilizer 20 and the guide wheels 23 were placed elsewhere along the vertical stabilizer 20 would not deviate from the scope of the invention. Alternatively, the tractor 22 could be removed from the vehicle transporter 18 and replaced with a set of guide wheels 23. In such an embodiment, each vehicle transporter 18 could be associated with, and derive motion from, one or more tractors 22 fixedly located within the parking structure 10 and acting as winches. A chain, cable or other connector could be employed to transmit motion from the one or more tractors 22 to the guide wheels 23 or other point along the vehicle transporter 18.

As was noted above, the parking structure 10 may also comprise one or more rails, tracks or the like 46 which may engage the tractor 22 and the unpowered guide wheels 23 providing guidance for the tractor 22 and the unpowered guide wheels 23 and which may also support the weight of the vehicle transporter 18 and, when loaded, a vehicle 14.

In the present embodiment, the lifting platform 26 is in turn comprised of rotary table 28 and dolly 30. As depicted more clearly in FIG. 1A, a vehicle 14 is engaged by the dolly 30. The lifting platform 26 can be independently raised or lowered on the vertical stabilizer 20 by use of a winch 24, which in one embodiment is an electrically powered winch attached to lifting platform 26 and counterweight 48 by a lifting chain or cable 50. Alternatively, the winch 24 may be mounted on the lifting platform 26 and/or may act to raise and lower the lifting platform 26 by way of a toothed drive system such as by driving a gear which engages a toothed track mounted on the vertical stabilizer 20.

Figure 2:
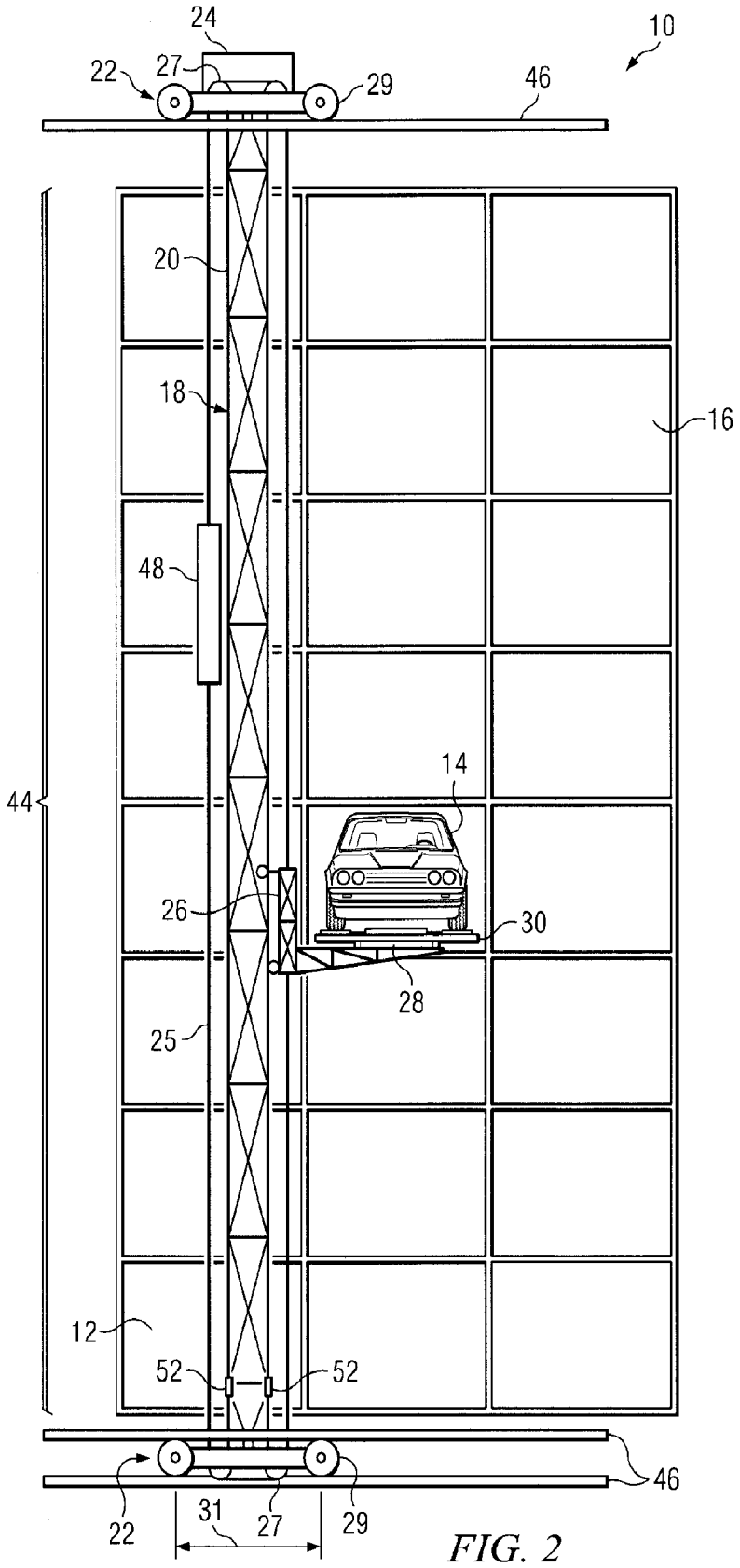
FIG. 2 shows an alternative embodiment of the parking structure with mast, upper and lower tractors and vehicle transporter.

Turning to FIG. 2, in a preferred embodiment, powered tractors 22 are located at both the top and the bottom of the vertical stabilizer 20. Because both ends of the vertical stabilizer 20 are driven, it may no longer be necessary for the vertical stabilizer 20 to have sufficient strength and rigidity such as may be required to transmit driving force from a single tractor 22 to a set of unpowered guide wheels 23, as was depicted in FIG. 1. However, this may be true if the position of each tractor 22 is maintained relative to the other. Thus synchronizer 25 may be provided to maintain this positioning by, for example, mechanical mechanisms. In one embodiment, a shaft and gears can be used to connect the two tractors. In other embodiments the mechanisms could use a chain, a toothed belt or belts or other mechanical means. Alternatively, electronic means may be used to provide position information to an electronic controller. In this embodiment, devices generate electronic signals that are related to the motion and/or position of each tractor 22. An electronic controller can use those signals in its control logic to establish the position of each tractor 22, both in absolute and relative terms. In addition, the controller can cause either or both tractors 22 to adjust position so that the desired position of each tractor 22 is maintained. The electronic means is the preferred embodiment for this invention.

FIG. 2 also depicts an embodiment of the present invention in which the vertical stabilizer 20 is mounted to the upper and lower tractor 22 by a non-rigid connection 27 such as a hinge or ball and socket joint. Driving the upper and lower tractors 22 in a coordinated fashion will allow the vertical stabilizer 20 to be mounted in a non-rigid fashion thus avoiding or lessening induced moments into the vertical stabilizer 20 and/or the tractors 22. Since induced moments may be either eliminated or reduced, the driven wheels 29 of the tractors 22 and the track 46 will not have to resist those loads. Also, the strength requirements for the vertical stabilizer 20 may be reduced. It should also be noted that although tractor 22 is depicted as having wheels 29, and the unpowered drive wheels 23 are shown as having wheels, the use of wheels is not a necessary part of the present invention. Tracks, slides or the like may be substituted without deviating from the scope of the invention.

Additionally, as depicted in FIG. 2 and FIG. 4, the use of a non-rigid connection 27 between the vertical stabilizer 20 and/or the tractors 22 may allow a narrower tractor wheelbase 31 because it is no longer providing stability and vertical positioning for the vertical stabilizer 20. The narrow wheelbase 31 also allows a smaller end zone 54 for parking a vehicle transporter 18 thus allowing the adjacent vehicle transporter 18*a* to reach the parking slots normally serviced by the parked vehicle transporter 18. As noted earlier, FIGS. 2 and 4 also depict an alternate embodiment of framework 44. In this embodiment, vertical elements of framework 44 divide each parking space 16. Although this embodiment may restrict an operators ability to easily alter the area allotted for each parking space 16, it has advantages in cost and vertical space saving. Specifically, the use of additional vertical elements in framework 44 allows for the use of shorter horizontal spans. Because these horizontal elements have a reduced span, they need not be as thick as the longer spans depicted in FIG. 1. Thus, the overall height of each level of parking spaces may be reduced.

As seen in FIG. 2, the vertical stabilizer 20 includes an automatic length compensator/adjustor 52 that allows the vertical stabilizer 20 to expand and contract in the direction of the major axis (in this case vertical) while preventing the vertical stabilizer 20 from deviating significantly from the normal straight line orientation. This feature will allow for variations in the distance between the upper and lower tractors 22.

As depicted in FIG. 2, the vertical stabilizer 20 will not be compressively loaded as it is supported by the upper tractor 22, which is in turn supported by the upper rail 46. The vertical stabilizer 20 will be in tension or bending or both depending on the selected lift method. In a preferred embodiment, the arrangement of the winch 24 and the lifting platform 26 will be such that the vertical stabilizer 20 is not subjected to the compressive forces associated with lifting the vertical load of the lifting platform 26 and, if present, a vehicle 14. In this embodiment, this load will be taken by one or both of the tractors 22, or if present, the unpowered guide wheels 23. This load may then be transferred directly to the rails 46, and from there to the framework 44, or if applicable, to the foundation or floor of the parking structure 10. The vertical stabilizer 20 may be subjected only to the loading associated with the bending moments from supporting the lifting platform 26 and, if present, a vehicle 14, and the reaction forces to the movement of the rotary table 28 if present. This feature, in combination with the automatic adjustor 52, may reduce the strength requirements for the vertical stabilizer 20, which in turn may allow for a lighter, and less costly vertical stabilizer 20. Furthermore, a lighter vertical stabilizer 20 will also reduce the horsepower required to accelerate and stop the vehicle transporter 18, as well as reduce the strength requirements of the components to which it attaches such as the rails 46, and indirectly, the framework 44.

In the two different embodiments disclosed above and shown in FIGS. 1 and 2, the vertical stabilizer 20 takes the form of a substantially rigid mast-like structure. Turning now to FIGS. 3*a*, 3*b*, and 3*c*, in an alternate embodiment, the vertical stabilizer 20 may take the form of one or more vertically oriented guides such as cables, shafts or the like. The vertical guidance of the lifting platform 26 is provided by the stiffness of the shaft or cable. As with the previous embodiment, automatic adjustors 52 are provided in this embodiment as well, although the sizing function may be accomplished by one or more springs or slip bearings. If the shafts or cables, mounted to the upper and lower tractors 22, can not provide sufficient stiffness, an intermediate tractor 22*a* can be provided to impart additional resistance to deflection.

Turning to FIGS. 3*b* and 5, in a preferred embodiment, the vertical stabilizer 20 of a vehicle transporter 18 may be comprised of a plurality of vertical elements formed in a frame. As in the previous figures, a winch 24 may be provided to supply lifting power, while the tractor(s) 22 may be provided to supply horizontal movement. Of course, as previously described, the tractor(s) 22 may be replaced with unpowered guide wheels 23 and/or moved to various locations either on the vehicle transporter 18 or to various locations within the parking structure 10. As shown in FIGS. 3*b* and 5, the use of a plurality of vertical stabilizers 20 may provide the benefit of added stability within the vehicle transporter 18 as the use of multiple vertical stabilizers 20 may distribute any loads associated with the lifting platform 26, and, if present, a vehicle 14.

In one embodiment of the parking structure, illustrated in FIG. 4, the vehicle transporters 18, 18*a* and the parking structure 10 are designed to allow either vehicle transporter 18, 18*a* to service all of the parking spaces 16. In this embodiment, the vehicle transporters 18, 18*a* are designed such that the lifting platforms 26, 26*a* face each other and/or overlap in their reach. As shown, the lifting platform 26 extends to the right of the vehicle transporter 18 such that when the vehicle transporter 18 is parked in the end zone 54, the lifting platform 26 may still reach the parking spaces 16 and the transfer room 12 in the leftmost column of the parking structure 10, labeled as spaces 1-1 through 7-1 and transfer room A. Furthermore, the lifting platform 26*a* associated with the vehicle transporter 18*a*, extends to the left of the vehicle transporter 18*a* such that it overlaps the lifting platform 26 and is also able to access the parking spaces 16 and the transfer room 12 in the leftmost column of the parking structure 10, labeled as spaces 1-1 through 7-1 and transfer room A. Note that without this opposing/overlapping orientation of the lifting platforms 26, 26*a*, lifting platform 26*a* would be unable to access spaces 1-1 through 7-1 and transfer room A. Specifically, associated vehicle transporter 18*a* would be unable to traverse far enough to the left to align the lifting platform 26*a* with those spaces and transfer room as vehicle transporter 18*a*'s path would be blocked by vehicle transporter 18. The inability to access one or more of the spaces 16 and transfer rooms 12 may be especially disadvantageous in the event that one or more of the vehicle transporters 18 are rendered inoperable through breakdown or routine maintenance which may strand one or more vehicles in the parking structure 10. While the overlapping orientation depicted here possesses the advantages described, an alternate orientation wherein the lifting platforms 26, 26*a* do not overlap, are able to access all of the spaces 16 and transfer rooms 12 without overlapping, or wherein each vehicle transporter was not able to service the entire parking structure, would not deviate from the scope of the present invention. Furthermore, in certain applications, due to design considerations such as cost and available space, a non-overlapping orientation, or a design in which each vehicle transporter was not able to service the entire parking structure may be preferred.

Furthermore, as depicted in FIG. 4, in a preferred embodiment, the parking structure 10 may be constructed with multiple arrays of parking spaces 16. In particular, in a preferred embodiment, the vehicle transporters 18 are restricted to linear travel along a path within the vehicle parking structure 10. Parking spaces 16 may be arrayed on opposite sides of the vehicle transporter 18, perpendicular to the direction of travel of the vehicle transporter 18. As will be discussed in greater detail in the discussion of FIG. 15, dolly 30 may be deployed from multiple sides of the vehicle transporter 18 such that it may service parking spaces 16 on corresponding sides of the vehicle transporter 18.

Turning to FIGS. 5 and 13 in combination, one embodiment of the lifting platform 26, dolly frame 110 and dolly 30 is depicted. Although the structure associated with a rotary table is not depicted in FIG. 5, the use of a rotary table is depicted as dolly frame 110 is shown skewed relative to lifting platform 26. Again, although the structure associated with a rotary table is not shown in FIG. 5, such structure enables the dolly 30 to rotate about an axis, while the dolly 30 provides a substantially planar top surface 56 having a major axis 58 and a minor axis 60, and a substantially centrally located slot 62 orientated along the major axis 58 through which spine 36 and tongue 114 travel. The top surface 56 and the dolly 30 are orientated so that substantially all of portions of the dolly 30 that travel underneath a vehicle 14 are located above the top surface 56. In particular, the first slidable section 32, the second slidable section 34, the spine 36, the tongue 114, and the tire engagement arm pairs 64*a*-64*d* are able to pass above the top surface 56. As will be discussed in greater detail in the discussion below, the dolly 30 is operationally engaged with the lifting platform 26 such that the dolly 30 may be deployed from the lifting platform 26 and positioned under a vehicle 14, whereupon it may engage and lift the vehicle 14 such that it may be moved on or off of the lifting platform 26.

In a preferred embodiment, the lifting platform 26 and/or the dolly 30 may be tilted about the minor axis 60, by a tilt actuator employing one or more of a number of known technologies. For example, an automated hydraulic jack may engage the lifting platform 26 and the dolly 30 to tilt the dolly 30 relative to the lifting platform 26. Alternately, the lifting platform 26 may be tilted from horizontal with the winch 24 acting as a tilt actuator. For example, the winch 24 may engage the lifting platform 26 by one or more cables, chains or the like attached at various points on the lifting platform 26. By selectively engaging one or more of such cables, chains or the like, the winch 24 may tilt the lifting platform 26 which carries the dolly 30. It may be appreciated that each of the parking spaces 16 associated with the parking structure 10 has a substantially planar floor 17. To facilitate water run off from either rain or snow carried in by a vehicle 14 or for cleaning operations, the floor 17 may be tilted relative to the horizontal plane, generally such that the edge of the floor 17 adjacent to the lifting platform 26 is higher than the opposite end. However, because of the tilt in the floor 17, if the dolly 30 were deployed from the lifting platform 26 in a substantially horizontal manner, the dolly 30 would be subjected to bending loads along the spine 36 and/or tongue 114 caused by the leading edge of the dolly 30 being cantilevered over the floor 17. By tilting the lifting platform 26 to an angle that substantially matches the angle of the floor 17, the bending loads along the spine 36 and/or tongue 114 may be greatly reduced as the leading edge of the dolly 30 will engage the floor 17 relatively quickly once it has been deployed.

Turning to FIG. 6, the dolly 30 is depicted in a first closed position, with the top surface 56 depicted in phantom. The dolly 30 is comprised of a first slidable section 32, a second slidable section 34, a spine 36, and tire engagement arm pairs 64*a*-64*d*. Each tire engagement arm pair 64*a*-64*d* is deployed to engage a single tire of a vehicle 14 to be moved. The tire engagement pairs 64*a*-64*d* are associated with the first and second slidable sections 32 and 34. As depicted, the first slidable section 32 is associated and moves with, tire engagement arm pairs 64*a* and 64*b*, while the second slidable section 34 is associated and moves with tire engagement arm pairs 64*c* and 64*d*. Thus, each slidable section 32, 34, in connection with its associated tire engagement arm pairs 64*a*, 64*b* and 64*c*, 64*d* respectively, engages the tires associated with a single vehicle axle. In operation, the first and second slidable sections 32 and 34 are displaced along the major axis 58 such that they accommodate the wheelbase of the vehicle 14 to be moved. As is best seen in FIG. 7, once in place, the first and second slidable sections 32 and 34 may be temporarily locked in place by locking mechanism 35. In a preferred embodiment, the displacement of the first and second slidable sections 32 and 34 may be performed prior to or during deployment of the dolly 30 under the vehicle 14. In a preferred embodiment, the vehicle parking structure 10 may also include a vehicle measuring system capable of measuring and storing at least the wheelbase of a vehicle 14 to be moved. Since the vehicle wheelbase is known prior to the vehicle transporter 18 reaching the vehicle 14, it is possible to preadjust the displacement of the first and second slidable sections 32 and 34 prior to insertion under the vehicle 14. By preadjusting the slidable section displacement, valuable time is saved during the vehicle movement process as the steps of measuring and adjusting the slidable sections 32 and 34 does not need to be undertaken after the vehicle transporter 18 reaches the vehicle 14 or after the dolly 30 is positioned under the vehicle 14.

Turning to FIG. 7, slidable section 32 of the dolly 30 is depicted in a second open position. While the following discussion will focus only on slidable section 32, it should be understood that it is equally applicable to slidable section 34 and corresponding elements of the slidable section 34. In this figure, the tire engagement arm pairs 64*a* and 64*b* have been opened such that they are substantially parallel to the minor axis 60. Each of the tire engagement arm pairs 64*a* 64*b* are comprised of at least two tire engagement arms 66, which in the embodiment depicted, are substantially wedge-shaped and oriented such that leading edge of each wedge is positioned to first engage a vehicle tire, however, the arms 66 may take other shapes without departing from the scope of the invention. Each of the arms 66 is supported at its inboard edge by a hinged connection 68 with the slidable section 32, and by one or more wheels 70 at its outboard edge. Referring back to FIG. 6, it is of note that when in the first closed position, the arms 66 are not carried parallel to the top surface 56. In particular, the wheels 70 are raised from the top surface 56 by an angle of loft 72. The angle of loft 72 is sized such that the wheels 70 do not contact the top surface 56 as, while in closed the position, the wheels 72 are transverse to the direction of travel along the major axis 58. Thus, without the angle of loft 70, when the dolly 30 or the slidable sections 32 or 34 were moved in the direction of the major axis 58, the wheels 70 would create undesirable drag, hindering performance of the dolly 30.

Returning to FIG. 7, it can be seen that each of the arms 66 associated with tire engagement arm pairs 64*a* and 64*b*, are separated from their respective pair by a separation distance 74. In general, the separation distance 74 is set by the overall dimensions of the slidable section 32 or 34 with which it is associated, but at a minimum is large enough to accommodate a vehicle tire.

Turning to FIG. 8, the dolly 30 is depicted in a third pinched position. In this position, the separation distance 74 has been reduced relative to that shown in FIG. 7, and thus each of the arms 66 is now relatively closer to its pair. In a preferred embodiment, the separation distance 74 is now, at a maximum, small enough to ensure that the tires of the vehicle 14 have been lifted from the surface of the lifting platform 26 or parking space 16. In a more preferred embodiment, the separation distance 74 is approximately 6.3 inches. The separation distance 74 is closed through the action of pinching actuator 76. In a preferred embodiment, the pinching actuator 76 comprises an electro/mechanical linear actuator although alternate designs such as the use of a hydraulic actuator, servo motors or mechanical linkages may also be used without departing from the scope of the invention. In a preferred embodiment, the pinching actuators 76 are also responsible for extending the arms 66 from the closed position depicted in FIG. 6 and to the open position shown in FIG. 7.

Turning to FIG. 9, in a more preferred embodiment, the pinching actuator 76 operates on the arms 66 via a mechanical linkage. A first end 90 of the pinching actuator 76 may be hingedly connected to frame 78 of the slidable section 32 or 34. A second end 92 of the pinching actuator 76 may be hingedly connected to first linkage arm 94. The first linkage arm 94 includes first and second hinge points 96 and 98. The first hinge point 96 is hingedly connected to slidable section upper plate 97 while the second hinge point 98 is hingedly connected to first end 100 of second linkage arm 102. Finally, second end 104 of the second linkage arm 102 is hingedly connected to the arm 66. The pinching actuator 76, first linkage arm 94 and second linkage arm 102 are preferably dimensioned such that, in operation, once the pinching actuator 76 has fully operated against the first linkage arm 94, the arm 66 will be fully extended and substantially perpendicular to the major axis 58. Furthermore, the first linkage arm 94 and the second linkage arm 102 will be in an over center or hyper extended relation such that they are in a non-linear relation while the hinge 106 defined by the second hinge point 98 and the first end 100 is in contact with an adjustable stop (not shown). Alternatively, the hinge defined by the second hinge point 98 and the first end 100 could be in contact with the arm 66 or some other structure which limits its movement and prevents additional flexing of the hinge. With this arrangement, any force 108 exerted on the arm 66 by a tire of the vehicle 14, which would otherwise act to collapse the arm 66, will instead be arrested by the contact between the hinge 106 and the adjustable stop (not shown). The arm 66 will collapse to a position adjacent to the frame 78 when the pinching actuator 76 retracts, pulling the first linkage arm 94 and the second linkage arm 102 out of the over center or hyper extended orientation and allowing them to collapse against each other. In an alternate embodiment, the arms 66 may be locked in the extended position during vehicle engagement through the use of a pin or other mechanical means. Alternatively, the force applied by the pinching actuator 76 may be sufficient to prevent the arm 66 from collapsing against the frame 78.

As discussed above, the dolly 30 is comprised, in part, of first and second slidable sections 32 and 34. Turning to FIG. 10, a single, representative slidable section 32 or 34 is shown. The slidable sections 32 and 34 are comprised of a generally rectangular, box steel frame 78 with a central cross brace 80, although alternate materials with alternate cross sections could be used to construct the frame 78 such as composites or plastics without deviating from the scope of the invention. In the embodiment depicted, six (6) wheels 82 are mounted along the perimeter of the frame 78, although an alternate number of wheels placed in alternate configurations would also be acceptable. In a preferred embodiment the wheels 82 are 3 inch outside diameter by 1.75 inch wide polyurethane wheels manufactured by Sunray, Inc. of Rutherfordton, N.C. When a vehicle 14 is loaded onto the dolly 30, the wheels 82 and arm wheels 70 bear the load of the vehicle. The Dolly 30 further comprises rollers 84 which engage the spine 36 (depicted in FIGS. 5-8). The rollers 84 act to align the slidable sections 32 and 34 with the spine 36 to encourage linear travel of the dolly 30.

Turning to FIG. 11, the dolly 30 is again depicted with the slidable sections 32 and 34 and the spine 36. Here, the slidable sections 32 and 34 are depicted in a first, proximate position. Turning to FIG. 12, the slidable sections 32 and 34 are depicted in a second, distant position. With reference to both FIGS. 11 and 12, separators 86 are depicted. In a preferred embodiment, the separators 86 comprise one or more devices capable of moving the slidable sections 32 and 34 relative to each other. Examples of suitable devices include electro/mechanical linear actuators, lead screw mechanisms and/or hydraulic rams mounted substantially parallel to the major axis 58 and fixedly connected at opposing ends to the slidable sections 32 and 34 respectively such that operation of the separators 86 acts to increase or decrease the separation between the slidable sections 32 and 34. In operation, in a preferred embodiment, as the dolly 30 is extended under a vehicle 14, the slidable sections 32 and 34 are pre-positioned to match the wheelbase of the vehicle 14. As previously discussed, this pre-positioning eliminates the need to accomplish the sizing function after the dolly 30 has been placed under the vehicle 14, potentially reducing the time necessary to engage the vehicle 14.

Turning to FIG. 13, the dolly 30 is depicted as fully extended from the lifting platform 26. The spine 36 is extended, and the slidable sections 32 and 34 are in the proximate position while the arms 66 are in the closed position. One or more collision detectors 88 may be affixed to the dolly 30 such that in the event vehicle transporter contacts a person or structure, the collision detector 88 may sense the contact, and preferably halt or reverse motion of the dolly 30. Collision detectors 88 may be of any one of a number of known technologies. For example, collision with an object may cause the movement or deflection of a collision detector 88 which in turn may complete an electric circuit or compress a piezoelectric load cell creating a signal which may alert the dolly 30 to quickly halt or reverse direction. Collision detection is a well-studied art and of particular use in the robotics industry. As such, companies such as RAD of Tipp City, Ohio supply collision detection systems utilizing pneumatics and/or mechanical triggering systems to the robotics industry. Similarly, U.S. Pat. No. 4,821,584 to Lembke illustrates a collision detection system including a piezoelectric load cell.

FIGS. 14, 14*a* and 15 further illustrate additional aspects and details of the dolly 30. In these figures, the terms left and right are used to describe locations and movement in relation to the figures and should not be taken as any limitation of the present invention.

FIG. 14 depicts dolly 30 positioned adjacent to a vehicle 14 which is positioned on the floor 17 of a parking space 16. Of course, the same arrangement would be found if the vehicle 14 were positioned in a transfer room 12. FIG. 14*a* depicts dolly 30 having deployed the first slidable section 32, the second slidable section 34, and the spine 36 under the vehicle 14. Of course, additional elements, such as the tire engagement arm pairs 64*a*-64*d* and the wheels 82 (depicted in FIG. 6) are also deployed under the vehicle 14, however, they are not distinguishable in FIG. 14*a*. However, as shown in FIG. 14*a* the deployed elements of the dolly 30 are dimensioned such that they fit between the floor 17 of the parking space 16 and bodywork of the vehicle 14. In other words, it will be understood that the wheels 82 travel on the same plane as that on which the tires of the vehicle 14 travel. Specifically, in a preferred embodiment, the height of the deployed elements of the dolly 30 are less than about 4.0 inches, and in a more preferred embodiment, less than abut 3.8 inches.

Turning to FIG. 15, in a preferred embodiment, a push/pull mechanism associated with dolly 30 is depicted. The push/pull mechanism is comprised of frame 110, carriage 112, tongue 114, the spine 36, carriage/spine cable 116, carriage tongue cable (left) 118, carriage tongue cable (right) 120, carriage drive chain 122, drive motor 124, and a number of attachment points, guides and pulleys described in more detail below. As shown schematically in FIG. 15, the drive motor 124 is mounted within the frame 110 and connected by the carriage drive chain 122 to the carriage 112. The drive chain 122 is routed around drive sprocket 125 and then the first and second idler sprockets 126 and 128, first and second carriage sprockets 130 and 132 and fixedly mounted to the carriage 112. In operation, the rotation of the drive motor 124 in a counterclockwise direction as depicted in FIG. 15 will result in the movement of the carriage 112 from right to left. Clockwise rotation of the drive motor 124 will result in movement of the carriage 112 from left to right. In either case, the carriage 112 is supported and guided in its travel by guide rails 134. Of course, alternate motive mechanisms and layouts could be implemented without deviating from the scope of the invention. For example, the drive motor 124 could be mounted within the carriage 112 and could drive the carriage 112 by means of a gear fixedly mounted to the drive motor 124 engaging a toothed track mounted along or integral with the guide rails 134.

As the carriage 112 travels in the right to left direction, it engages a number of additional cables and pulleys which translate and amplify the motion of the carriage 112 to the tongue 114 and the spine 36, causing the deployment of the spine 36 to the left of the frame 110. As shown, the carriage tongue cable (left) 118 is fixedly mounted to the frame 110 at frame attachment point (left) 138, travels in a generally vertical orientation, wrapping around the main pulley stack 136, the frame pulley stack (left) 142, the frame pulley stack (right)

144, and is fixedly attached to the tongue 114 at tongue attachment point (left) 146. Similarly, the carriage tongue cable (right) 120 is fixedly mounted to the frame 110 at frame attachment point (right) 140, travels in a generally vertical orientation, wrapping around the main pulley stack 136, the frame pulley stack (right) 144, the frame pulley stack (left) 142, and is fixedly attached to the tongue 114 at the tongue attachment point (right) 148. It will be appreciated that, although not depicted in FIG. 15, pulley stacks 136, 142 and 144 are each comprised of multiple pulleys which are able to spin independently of each other. As the carriage 112 moves right to left, the carriage tongue cable (left) 118, and the carriage tongue cable (right) 120 transmit the motion of the carriage 112 to the tongue 114 which is supported and guided by, for example, an inverted C-channel which interfaces with the frame 110. Furthermore, because the carriage tongue cable (left) 118, and the carriage tongue cable (right) 120 are wrapped around the main pulley 136 which moves with the carriage 112, the motion of the carriage 112 is doubled as applied to the tongue 114, similar to the manner in which a block and tackle operates. That is, the inclusion of the main pulley 136 serves to translate every one unit of horizontal movement of the carriage 112 into two units of horizontal movement of the tongue 114.

Furthermore, the carriage 112 is also fixedly mounted to the carriage spine cable 116 at the carriage attachment point 150. The carriage spine cable 116 is looped around first and second tongue pulleys 152, 154 in a generally horizontal orientation. The tongue pulleys 152 and 154 are rotatably mounted to the tongue 114 such that the tongue pulleys 152 and 154 move in unison with the tongue 114. Finally, the spine 36 is fixedly attached to the carriage spine cable 116 at tab 156. The motion of the carriage 112 in the right to left direction is thus transmitted to the spine 36 via the carriage spine cable 116. The spine 36 is supported and guided by a system of blocks fixed to the spine 36 which engage channels in the tongue 114 thereby ensuring substantially linear movement of the spine 36 in relation to the tongue 114. This arrangement of blocks and channels could, of course, be reversed and alternate means of ensuring linear travel could be substituted without deviating from the scope of the invention.

It should be noted that because the spine 36 is fixedly mounted to the carriage spine cable 116, and that the carriage spine cable is mounted to the tongue 114 via the tongue pulleys 152 and 154, any travel of the carriage 112 is naturally transmitted to the spine 36 through its connection with the tongue 114. Thus, as with the tongue 114, every one unit of travel by the carriage 112 results in two units of travel of the spine 36. However, the carriage 112 is also transmitting motion to the spine 36 via the carriage spine cable 116, resulting in an additional one unit of travel for the spine 36 for every unit of travel of the carriage 112. Thus, taken together, for every one unit of travel of the carriage 112 in the right to left direction, the spine 36 experiences three units of travel in the right to left direction. Of course, the motion of the carriage 112 in the left to right direction simply reverses all of the previously described motion making it possible to deploy the spine 36 to the right of the frame 110.

As a result of the arrangement of the spine 36, the tongue 114 and the carriage 116, small movements of the carriage 112 are amplified three times in the spine 36. The benefit in this arrangement is that while the movement of the carriage 112 is limited within the frame 110, the spine 36 must be able to extend fully under the vehicle 14 such that the arms 66 may engage all four tires of the vehicle 14. Of course, alternate embodiments of motion amplifiers, such as the use of different sized gears responsible for imparting motion to the different components are possible without deviating from the scope of the invention.

In operation, a vehicle 14 may be parked within the vehicle parking structure 10 as follows. First, a vehicle may enter one of one or more of the vehicle transfer rooms 12. Once in the vehicle transfer room 12, the vehicle 14 may be measured for overall dimensions of length, width, height, ground clearance and wheelbase to ensure that each dimension falls within pre-determined parameters, and its position within vehicle transfer room 12 may also be measured. In particular, the location of the vehicle 14 relative to one or more known reference points such as the walls of the vehicle transfer room 12 may be determined, as well any skew of the vehicle relative to the walls of the vehicle transfer room 12. Alternately, if the vehicle 14 is known to the vehicle parking structure 10, such as if the vehicle transmits an identification signal to the system or if the vehicle is otherwise identified to the vehicle parking structure 10, a determination step, rather than a measuring step may be carried out. In particular, based on the vehicle identification received by the vehicle parking structure 10, a lookup table containing the vehicle identification correlated with vehicle characteristics such as the vehicle's spatial dimensions, could be consulted to determine the vehicle's 14 length, width, height and wheelbase. Of course, the step of determining the position of the vehicle 14 within the vehicle transfer room 12 could still be carried out. Furthermore, rather than completely eliminating the vehicle measuring step, a reduced or modified measurement could be taken to ensure that the determined vehicle characteristics match the actual characteristics of the vehicle 14 in the vehicle transfer room 12. Alternately, the vehicle 14 may be measured or its spatial dimensions determined prior to its entering a transfer room 12.

Once the dimensions and position of the vehicle 14 are either measured or determined, this data may be transferred to the control system 21. The control system 21 may then pre-adjust one of the one or more vehicle transporters 18, specifically the positions of the slidable sections 32 and 34, to correspond to the measured or determined wheelbase of the vehicle 14. Control system 21 may also perform additional functions such as determining optimal placement of the vehicle 14 within the parking structure 10. Specifically, based on the dimensions of the vehicle 14, the control system may select a parking space 16 in which to place vehicle 14 from a range of available parking spaces 16 which may have varying dimensions. Control system 21 may select an available parking space 16 which will best accommodate vehicle 14.

The vehicle parking structure 10 may also perform a vehicle occupancy step to verify that the vehicle 14 is unoccupied. Once the vehicle parking structure 10 has determined that the vehicle 14 is unoccupied (either by a signal given by an operator or through one or more automated means) and acceptable for movement, if available, one of the one or more vehicle transporters 18 will approach the transfer room 12 to begin the vehicle acquisition process. Once the vehicle transporter 18 and the lifting platform 26 have been positioned adjacent to the transfer room 12, the dolly 30 will be deployed from the lifting platform 26.

Because the dimensions and position of the vehicle 14 have already been measured, the dolly 30 may be pre-adjusted to accommodate the size of the vehicle 14, and, if necessary, non-ideal positioning of the vehicle 14 within the transfer room 12. Specifically, because the wheelbase of the vehicle 14 has been measured or determined prior to deployment of the dolly 30, the separation of the slidable sections 32 and 34 may be set before or as the dolly 30 is deployed. Similarly, because the placement of the vehicle 14 is known, it may be possible, through an adjustment of the position of the vehicle transporter 18 and/or by rotating the dolly 30 through the use of the rotary table 28, to accommodate a vehicle 14 which is skewed in relation to the transfer room 12. Furthermore, this flexibility may remove the need for structures within the transfer room 12 such as tire guides or the like.

Once the dolly 30 has been deployed under the vehicle 14, as previously described, the arms 66 are deployed and engage and lift the wheels of the vehicle 14. With the vehicle 14 lifted from the floor of the vehicle transfer room 12, the dolly 30 returns to the lifting platform 26 with the vehicle 14. Once the vehicle 14 has been transferred to the lifting platform 26, the vehicle transporter 18 may move laterally and/or the lifting platform 26 may move vertically such that the vehicle 14 may be positioned adjacent to an empty parking space 16. Once the lifting platform 26 is adjacent to a parking space 16 in which the vehicle 14 is to be parked, an alignment device (not shown) may be deployed to ensure that the lifting platform 26 remains relatively motionless and adjacent to the desired parking space 16 when the vehicle 14 is offloaded. The alignment device may take a number of forms however, a ramp or one or more arms which extend from the lifting platform 26 and which includes one or more engagement points capable of engaging reciprocal points adjacent to the parking space 16 is preferred. If necessary, in one embodiment, either the dolly 30 or the lifting platform 26 may be tilted such that it departs from the horizontal at an angle which approximates the angle of slope of the floor 17 of the parking space 16. To park the vehicle 14, the dolly 30, carrying the vehicle 14 is deployed from the lifting platform 26 and into the parking space 16. The vehicle 14 is lowered and the arms 66 are disengaged from the wheels of the vehicle 14. The dolly 30 is then retracted to the lifting platform 26. In a preferred embodiment, the dolly 30 is deployable from either side of the lifting platform 26. However, note that prior to parking the vehicle 14, the rotary table 28 may be used to rotate the dolly 30 such that the dolly 30 need deploy from only one direction relative to the rotary table 28.

To retrieve a vehicle 14 from a parking space 16, the process is reversed. In a preferred embodiment, the vehicle 14 is rotated at some point in the parking process such that the vehicle operator may drive the vehicle 14 in and out of the vehicle transfer room 12 without having to back in or out.

Turning to FIG. 16, a flowchart detailing the steps of a parking structure mapping operation are detailed. In step 1000, an initial, or set up step may be performed. In this step, an operator may enter data into the parking management system 21 representing physical characteristics of the parking structure 10 and/or the vehicle transporter(s) 18. Such data could include, but not be limited to, information regarding physical dimensions of the parking spaces 16 and transfer rooms 12 in the parking structure 10, such as length, width, height and location of the parking spaces 16 and the transfer rooms 12. Furthermore, data representing characteristics of the vehicle transporter(s) such as, but not limited to, location, rate of travel and the like, may be entered. Additional information regarding, for example, locations of end zones, obstructions, and fire suppression areas may also be entered.

In step 1010, a verification step may be performed. In this step, which may either be ordered by an operator or may occur automatically in the operation of the vehicle parking apparatus, the vehicle transporter(s) 18 are directed to a known location within the parking structure 10 associated with at least some of the data entered in step 1000 to verify the accuracy of the data entered in step 1000. Once the vehicle transporter(s) 18 arrive at the known location, the vehicle transporter attempts to engage or identify an indexing marker located at the known location. The indexing marker, which may comprise a beacon, transponder, reflector or the like, allows the parking management system 21 to identify an actual location within parking structure 10. In step 1020, the parking management system 21 compares the expected location of the indexing marker, $L_{EXPECTED}$ which may have been entered in the set up step 1000 against the actual location of the indexing marker $L_{ACTUAL}$ identified in step 1010.

If $L_{EXPECTED}$ agrees with $L_{ACTUAL}$, the process moves to step 1030 where the operation being carried out by the parking management system is continued. Such operation could be the verification step 1010 previously discussed, or, the operation may be vehicle-moving operation, in which case the parking management system 21 will perform the parking or retrieving operation as expected.

If however, $L_{EXPECTED}$ does not agree with $L_{ACTUAL}$, the process moves to step 1040 where the parking management system 21 may alter $L_{EXPECTED}$ to agree with $L_{ACTUAL}$, Following the alteration to $L_{EXPECTED}$, the process moves to step 1030 and the current operation is completed.

In step 1040, the parking management system 21 determines if additional operations requiring verification are needed. Such determination could be a self check of requested operations contained within the parking management system's 21 operation buffer, or could be a request for additional instructions from the system operator. In either case, such operations could include additional vehicle-moving operations if additional verification steps are requested in connection with the vehicle-moving operation, or could be additional verification steps if, for example, multiple locations are to be verified by the system. If additional operations are needed, the system returns to the verification step 1010. If no additional operations are needed, the process ends at step 1050.

Although the present invention has been described in terms of certain preferred embodiments, the various examples presented should not be interpreted as limitations on the scope of the present invention. Numerous embodiments and variations are possible which could be substituted without departing from the scope of the present invention.

The invention claimed is:

1. An apparatus for moving wheeled vehicles, wherein each vehicle has a front portion and a rear portion and being comprised of two pairs of wheels, one pair of wheels arranged at said front portion, one pair of wheels arranged at said rear portion, each wheel of each pair of wheels being positioned at a set wheel distance apart from a corresponding wheel of the pair of wheels, and wherein a transfer station of a parking structure has a plurality of vertically spaced parking floors, each parking floor being comprised of a plurality of parking spaces, each parking space having a front entrance and lateral sides, said front entrance being orthogonal to said lateral sides, said transfer station having a continuous flat floor, each vehicle being received on said continuous flat floor of said transfer station, said apparatus comprising:

a platform having a first end and a second end, said platform comprising:

a platform table;

a lifting means for said platform vertically relative to the parking floors;

a transporting means for said platform horizontally relative to the parking floors; and a rotation means for said first end of said platform and said second end of said platform relative to said front portion and said rear portion of each vehicle, said first end facing said rear portion when each vehicle is in said transfer station, said second end facing said front portion when each vehicle is in said transfer station; and a dolly having a major axis and a minor axis and being extendable from said platform, said major axis being aligned with a direction from said front portion to said rear portion, said minor axis being orthogonal to said direction from said front portion to said rear portion, said dolly comprising:

four pairs of lifting arms, each lifting arm having a folded position aligned on said major axis and an extended position orthogonal to said major axis, wherein a first set of two pairs of lifting arms are aligned with said one pair of wheels at said front portion, and wherein a second set of two pairs of lifting arms are aligned with said one pair of wheels at said rear portion, wherein said dolly extends along said continuous flat floor of said transfer station according to said major axis, said dolly extending from said first end of said platform when said rear portion of each vehicle faces said platform, said dolly extending from said second end of said platform when said front portion faces said platform, wherein said first set of two pairs of lifting arms engage each wheel of said one pair of wheels at said front portion, when each lifting arm swivels from said folded position, engages one side of each wheel, pivots on each wheel and slides along said major axis, so as to set said extended position orthogonal to said major axis and engaged to each wheel, wherein said second set of two pairs of lifting arms engage each wheel of said one pair of wheels at said rear portion, when each lifting arm swivels from said folded position, engages one side of each wheel, pivots on each wheel and slides along said major axis, so as to set said extended position orthogonal to said major axis and engaged to each wheel, wherein the first and second sets lift wheels of each vehicle from said continuous flat floor, said dolly retracting back to said platform table with the vehicle, and wherein said dolly extends from said platform table with the vehicle to said parking space, when said platform is aligned with said front entrance of a parking space, the first and second sets lowering the vehicle onto said parking space by releasing respective wheels of said two pairs of wheels, said dolly retracting back to said platform table.

2. The apparatus for moving, according to claim 1, further comprising: a tilting means for said platform relative to each parking floor, when said dolly extends from said platform with the vehicle.

3. The apparatus for moving, according to claim 1, further comprising: an aligning means for said platform relative to each park floor, when said dolly extends from said platform table with the vehicle.

4. The apparatus for moving, according to claim 1, further comprising: a motion amplifier on said platform, said motion amplifier engaging each lifting arm to a respective wheel of said two pairs of wheels.

5. The apparatus for moving, according to claim 1, wherein said dolly is rotatable on said platform table, said major axis of said dolly having orientation moveable 180 degrees between said first end and said second end of said platform, when the vehicle is on and off said platform table.

6. The apparatus for moving, according to claim 1, further comprising: a control system comprised of a vehicle measuring system, said vehicle measuring system detecting at least one vehicle characteristic of a group consisting of: length, width, height, skew, and wheelbase.

7. The apparatus for moving, according to claim 6, wherein said control system comprises:

a memory device, and an adjustment means for distance between the first and second sets, wherein said vehicle measuring system detects at least one vehicle characteristic of a group consisting of: length, width, height, skew and wheelbase, said memory device storing information corresponding to said at least one vehicle characteristic, said adjustment means setting said distance between the first and second sets according to said at least one vehicle characteristic.

8. The apparatus for moving, according to claim 7, wherein said at least one vehicle characteristic is wheelbase of the vehicle, said distance between the first and second sets corresponding to wheelbase.

9. The apparatus for moving, according to claim 1, further comprising:

a control system comprised of a vehicle measuring system, said vehicle measuring system detecting at least one vehicle characteristic of a group consisting of: length, width, height, skew and wheelbase, wherein an engagement distance, between said first set of two pairs of lifting arms and said second set of two pairs of lifting arms, corresponds to said wheelbase, when said at least one vehicle characteristic is wheelbase.

10. The apparatus for moving, according to claim 9, wherein the first set and the second set are fixed at a preliminary distance before engaging wheels and when said dolly extends from said platform, said preliminary distance being different from said engagement distance, the first set and the second set reaching said engagement distance from said preliminary distance when said dolly stops extending.

11. The apparatus for moving, according to claim 9, wherein said control system comprises:

a memory device, and an adjustment means for distance between the first and second sets, said memory device storing information corresponding to said at least one vehicle characteristic, aid adjustment means setting distance between the first and second sets to said engagement distance.

12. The apparatus for moving, according to claim 9, wherein the first set and the second set are fixed at a preliminary distance before engaging wheels and when said dolly extends from said platform, said preliminary distance being different from said engagement distance, the first set and the second set reaching said engagement distance from said preliminary distance when said dolly stops extending, further comprising:

a pinching actuator connected to each lifting arm by a mechanical linkage, said pinching actuator holding each lifting arm in said folded position, said pinching actuator driving each lifting arm between said folded position and said extended position, said pinching actuator setting each lifting arm in said extended position.

13. The apparatus for moving, according to claim 9, wherein each lifting arm in said folded position is stowed substantially parallel to a direction of movement of said dolly relative to said platform table, and wherein each lifting arm in said extended position is substantially perpendicular to said direction of movement of said dolly relative to said platform table.

14. The apparatus for moving, according to claim 9, wherein said dolly passed under the vehicle before the first set and the second set reach said engagement distance.

15. The apparatus for moving, according to claim 14, wherein said dolly has an extension height less than about 3.8 inches.

16. The apparatus for moving, according to claim 9, said dolly further comprising:

a main frame attached to said platform;

a spine connected to said main frame; and a plurality of sliding members, each sliding member being movable along said spine and extending from said platform table, each lifting arm being in hinged engagement with at least one sliding member.

17. The apparatus for moving, according to claim 16, said spine being extendable from said main frame, said spine comprising:

a drive motor on said main frame;

a carriage engaging said drive motor, said drive motor moving said carriage back and forth from said main frame; and a movable tongue connected by left and right tongue cables to said carriage, said left and right tongue cables having a pulley arrangement, wherein movement of said carriage corresponds to a greater movement of said movable tongue, wherein said movable tongue connects by a carriage spine cable to at least one sliding member, said greater movement of said movable tongue corresponding to movement of said spine.

18. The apparatus for moving, according to claim 16, further comprising:

a control system comprised of a vehicle measuring system, said vehicle measuring system detecting at least one vehicle characteristic of a group consisting of: length, width, height, skew and wheelbase, wherein said at least one vehicle characteristic is skew of the vehicle, and wherein said spine is steered according to said skew of the vehicle, said sliding members being aligned between said front portion and said rear portion of said vehicle.

19. The apparatus for moving, according to claim 9, wherein each lifting arm moves between said folded position and said extended position in coordination with at least one other lifting arm.

20. The apparatus for moving, according to claim 19, each lifting arm having a distal end and a proximal end, said distal end having a roller, said roller supporting each lifting arm against the vehicle and said continuous flat surface and against the vehicle and said platform table.

21. The apparatus for moving, according to claim 20, wherein each lifting arm in said folded position is disposed at a loft angle relative to said platform table.

22. A vehicle parking structure, wherein each vehicle has a front portion and a rear portion and being comprised of two pairs of wheels, one pair of wheels arranged at said front portion, one pair of wheels arranged at said rear portion, each wheel of each pair of wheels being positioned at a set wheel distance apart from a corresponding wheel of the pair of wheels, the parking structure comprising:

a transfer station having a continuous flat floor;

a plurality of vertically spaced parking floors, each parking floor being comprised of a plurality of parking spaces, each parking space having a front entrance and lateral sides, said front entrance being orthogonal to said lateral sides, each vehicle being received on said continuous flat floor of said transfer station;

an apparatus for moving according to claim 1; and a control system comprised of a vehicle measuring system, a memory device, and an adjustment means for distance between the first and second sets, said vehicle measuring system detecting at least one vehicle characteristic of a group consisting of: length, width, height, skew and wheelbase, said memory device storing information corresponding to said at least one vehicle characteristic, said adjustment means setting said distance between the first and second sets according to said at least one vehicle characteristic.

23. The parking structure, according to claim 22, wherein said at least one vehicle characteristic is wheelbase of the vehicle, said distance between the first and second sets corresponding to wheelbase.

24. The parking structure, according to claim 22, wherein said at least one vehicle characteristic is alignment position of the vehicle in said transfer station, said dolly extending from said first end of said platform, when said rear portion faces said first end of said platform, said dolly extending from said second end of said platform, when said front portion faces said second end of said platform, said first set corresponding to said front portion, said second set corresponding to said rear portion.

25. The parking structure, according to claim 22, wherein said at least one vehicle characteristic is alignment position of the vehicle in said transfer station, said dolly extending from said first end of said platform, when said rear portion faces said first end of said platform, said dolly extending from said second end of said platform, when said front portion faces said second end of said platform, said first set corresponding to said rear portion, said second set corresponding to said front portion.

26. The parking structure, according to claim 22, said control system being further comprised of a database of vehicle characteristics of each vehicle and a recognition means for each vehicle, said database arranging information corresponding to each vehicle, said recognition means identifying each vehicle by vehicle characteristics.

27. The parking structure, according to claim 26, said control system being further comprised of a selecting means for each vehicle and a corresponding parking space, at least one vehicle characteristic matching a feature of said corresponding parking space, said platform moving from said transfer room to said corresponding parking space.

* * * * *